US010434618B2

(12) United States Patent
Corrigan et al.

(10) Patent No.: US 10,434,618 B2
(45) Date of Patent: Oct. 8, 2019

(54) SHAPE-FORMABLE APPARATUS

(71) Applicant: 3M INNOVATIVE PROPERTIES COMPANY, St. Paul, MN (US)

(72) Inventors: Thomas R. Corrigan, St. Paul, MN (US); Marc A. Egeland, St. Paul, MN (US); Paul D. Graham, Woodbury, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 16/086,447

(22) PCT Filed: Mar. 17, 2017

(86) PCT No.: PCT/US2017/022889

§ 371 (c)(1),
(2) Date: Sep. 19, 2018

(87) PCT Pub. No.: WO2017/165215

PCT Pub. Date: Sep. 28, 2017

(65) Prior Publication Data

US 2019/0084114 A1 Mar. 21, 2019

Related U.S. Application Data

(60) Provisional application No. 62/312,911, filed on Mar. 24, 2016.

(51) Int. Cl.

| | |
|---|---|
| ***B24B 13/01*** | (2006.01) |
| ***B24D 15/04*** | (2006.01) |
| *B24B 35/00* | (2006.01) |

(52) U.S. Cl.

CPC ..... *B24B 13/012* (2013.01); *B24D 15/04* (2013.01); *B24B 35/00* (2013.01)

(58) Field of Classification Search

CPC ..... B24B 1/04; B24B 13/012; B24B 35/00; B24B 35/005; B24D 15/04

(Continued)

(56) References Cited

U.S. PATENT DOCUMENTS

| | | | |
|---|---|---|---|
| 1,062,214 | A | 5/1913 | Bergman |
| 4,314,827 | A | 2/1982 | Leitheiser et al. |

(Continued)

FOREIGN PATENT DOCUMENTS

| | | |
|---|---|---|
| FR | 2898290 | 9/2007 |
| JP | 60062469 | 4/1985 |

(Continued)

OTHER PUBLICATIONS

International Search Report, PCT/US2017/022889, dated Sep. 20, 2018, 4 pages.

(Continued)

*Primary Examiner* — Timothy V Eley
(74) *Attorney, Agent, or Firm* — Yufeng Dong; X. Christina Huang

(57) ABSTRACT

An apparatus can comprise a body and a first portion. The first portion can be coupled to the body and moveable therewith. The first portion can comprise a rigidifying material and a layer. The rigidifying material can be positioned in a chamber defined by an envelope formed of a gas-impermeable material. A pressure within the chamber can be variable between at least a lower pressure state and a higher pressure state. In the higher pressure state the material is relatively flexible, and in the lower pressure state the material can be relatively less flexible than in the higher pressure state. The layer can be manipulatable by the rigidifying material. More particularly, the layer can have a first state when the pressure within the chamber is in the higher pressure state. In the first state, the layer can be formable by (Continued)

the target surface to take on a desired shape that can be substantially a match of the target surface. The layer can have a second state when the pressure within the chamber is in the lower pressure state. In the second state, the layer can maintain the desired shape and can be substantially less formable than in the first state.

7 Claims, 17 Drawing Sheets

(58) Field of Classification Search
USPC ..... 451/495
See application file for complete search history.

(56) References Cited

U.S. PATENT DOCUMENTS 4,518,397 A 5/1985 Leitheiser et al.
4,623,364 A 11/1986 Cottringer et al.
4,657,003 A 4/1987 Wirtz
4,744,802 A 5/1988 Schwabel
4,770,671 A 9/1988 Monroe et al.
4,831,789 A * 5/1989 Herbin ..... B24B 13/0052 451/495
4,881,951 A 11/1989 Wood et al.
4,885,811 A 12/1989 Hayes
5,011,508 A 4/1991 Wald et al.
5,090,968 A 2/1992 Pellow
5,139,978 A 8/1992 Wood
5,201,916 A 4/1993 Berg et al.
5,203,123 A 4/1993 Travis
5,227,104 A 7/1993 Bauer
5,366,523 A 11/1994 Rowenhorst et al.
5,429,647 A 7/1995 Larmie
5,498,269 A 3/1996 Larmie
5,593,340 A * 1/1997 Nelson ..... B24B 13/01 451/42
5,695,393 A * 12/1997 Granziera ..... B24B 13/012 269/22
5,762,546 A * 6/1998 James ..... B24B 13/012 451/504
5,928,063 A * 7/1999 James ..... B24B 13/02 451/313
6,120,365 A 9/2000 Johnson
6,308,353 B1 10/2001 Van Steenburg
6,443,825 B2 * 9/2002 Schadoffsky ..... B24D 9/00 451/344
6,685,547 B2 * 2/2004 Boman ..... B24D 9/02 451/495
6,932,678 B2 * 8/2005 Toyoshima ..... B24B 13/005 451/277
7,066,794 B2 * 6/2006 Granziera ..... B24B 13/012 451/158
7,217,176 B2 * 5/2007 Schneider ..... B24B 13/012 451/283
8,210,909 B2 * 7/2012 Bernardi ..... B24B 9/00 451/356
2010/0054903 A1 3/2010 Jones et al.
2012/0084967 A1 * 4/2012 Toriumi ..... B24B 13/012 29/559
2012/0310126 A1 12/2012 Bureau et al.
2017/0341334 A1 * 11/2017 Corrigan ..... A61F 5/05833
2017/0360589 A1 * 12/2017 Corrigan ..... A61F 5/01
2017/0360590 A1 * 12/2017 Corrigan ..... A61F 5/01
2019/0021717 A1 * 1/2019 Corrigan ..... D04H 1/4218

FOREIGN PATENT DOCUMENTS

WO 2015-167910 A1 11/2015
WO WO 2016/100170 6/2016
WO WO 2016/100174 6/2016
WO WO 2016/100177 6/2016
WO WO 2016/100182 6/2016

OTHER PUBLICATIONS

Ou et al., "jamSheets: Thin Interfaces with Tunable Stiffness Enabled by Layer Jamming," TEI '14, (ACM), Feb. 16-19, 2014) 8 pages.
Liu et al, "Applications of non-circular cross-section chemical fibers" in Chemical Fibers International Dec. 2011; 4 pages.

* cited by examiner

SHAPE-FORMABLE APPARATUS

CROSS REFERENCE TO RELATED APPLICATIONS

This is a national stage filing under 35 U.S.C. 371 of PCT/US2017/022889, filed Mar. 17, 2017, which claims priority to U.S. Provisional Application No. 62/312,911, filed Mar. 24, 2016, the disclosure of which are incorporated by reference in their entirety herein.

TECHNICAL FIELD

This document pertains generally, but not by way of limitation, to shape-formable apparatuses and related methods. More specifically, without limitation, this document relates to apparatuses that are configured to be formed into a desired shape that can be substantially a match of a target surface and then can be held in the desired shape to perform various applications for manufacturing and other purposes.

BACKGROUND

Some existing shape-formable devices employ discrete particles (i.e., bulk media) in a gas impermeable envelope that normally move freely with respect to one another, but "jam" together and resist relative motion when the internal pressure of the envelope is reduced below ambient pressure. This jamming of bulk media has been proposed for a variety of products, from a medical restraint for babies (U.S. Pat. No. 4,885,811) to limb demobilization (U.S. Pat. No. 4,657,003), to the stabilization of patients during surgery (U.S. Pat. No. 6,308,353), to robotic end effectors (U.S. Publication No. 2010/0054903). One significant disadvantage of bulk media jamming is the significant volume required for a bulk media-filled device. Thus, bulk media does not lend itself well to all applications.

Other existing devices or systems employ bending stiffness variation in a thinner form factor. By putting sheets of material in an envelope and removing air from the envelope (e.g., as in U.S. Publication No. 2012/0310126 and Ou et al., "jamSheets: Thin Interfaces with Tunable Stiffness Enabled by Layer Jamming," TEI '14 Proceedings of the 8th International Conference on Tangible, Embedded and Embodied Interaction, pages 65-72, Association for Computing Machinery (ACM), February 2014), a relatively thin article can be achieved with a variable bending stiffness. They achieve a low bending stiffness in an unjammed state, despite having a high Young's Modulus (or tensile modulus), by allowing multiple thin layers of material to slide over each other. However, because these individual layers each have a high overall Young's Modulus, even in an unjammed state, and they are substantially continuous in one or more axes within the plane, they cannot be easily extended within the plane, or major surface, of the thin article. Because the individual layers lack this extensibility, the conformability of the layers is also limited. Thus, these layers can only take on complex shapes by generating wrinkles, and not by smoothly and continuously assuming arbitrary shapes.

All of these shape-formable devices have been used to hold objects in position or to have a variable degree of stiffness. None of these devices has been used to copy the profile (2D) or complex geometry (3D) of a surface for any purpose. Casts and molds have been used to copy the form of a surface, but those technologies are permanent and not easily changed from one surface to another.

OVERVIEW

The present inventors have recognized, among other things, that a variety of applications can benefit from a material and a device having a stiffness that can change from a first (flexible) state, in which the material is shape-formable to a desired shape, to a second (more rigid) state, in which the desired shape can be held or fixed. Such applications can include sanding, filling, smoothing, and molding, for example.

The present inventors have developed shape formable devices integrated with a functional layer, a means of manipulation of the functional layer, and a means of activation that would allow the functional layer to copy a shape of a target surface. The device would then use that copied shape to perform a useful function (e.g., sanding, filling, smoothing, molding, or the like). More particularly, the present inventors have developed devices and methods for capturing a desired shape of the target surface (e.g., by forcing a first portion of the apparatus against the target surface with the first portion in a flexible state that can conform to the target surface) and holding the desired shape for use in the variety of applications. Such force can be supplied by gravity, a user's hand, or another mechanism in some embodiments. As such, the present disclosure is generally directed to apparatuses and related methods that can utilize a shape-formable layer and other shape-formable structures.

According to one embodiment, the apparatus can comprise a body and a first portion. The first portion can be coupled to the body and moveable therewith. The first portion can comprise a rigidifying material and a layer. The rigidifying material can be positioned in a chamber defined by an envelope formed of a gas-impermeable material. A pressure within the chamber can be variable between at least a lower pressure state and a higher pressure state. In the higher pressure state the material is relatively flexible, and in the lower pressure state the material can be relatively less flexible than in the higher pressure state. The layer can be manipulatable by the rigidifying material. More particularly, the layer can have a first state when the pressure within the chamber is in the higher pressure state. In the first state, the layer can be formable by the target surface to take on a desired shape that can be substantially a match of the target surface. The layer can have a second state when the pressure within the chamber is in the lower pressure state. In the second state, the layer can maintain the desired shape and can be substantially less formable than in the first state.

According to some aspects of the present disclosure, the rigidifying material can comprise one and/or a combination of relatively thin sheets, fibers, strips of thin sheets, and discrete particles of a bulk media, or the like. The layer can comprise the envelope, an article adjacent the rigidifying material that is connected indirectly or directly thereto, an externally interfacing surface of the first portion, or an intermediate layer coated or otherwise covered with various additional layers or materials. Such layers or materials can form the externally interfacing surface of the first portion, for example. Thus, in one embodiment an abrasive layer can be disposed on and secured to the layer. In such embodiment, the apparatus can be used for sanding a surface of an object with the abrasive layer. The sanding can occur with the layer having the desired shape and the chamber in the lower pressure state.

In another embodiment, a method of using an apparatus as a copy block is disclosed. The method can comprise providing the apparatus including a body and a first portion coupled to the body. The method can further comprise passing a gas to and from a chamber within the first portion such that the chamber has at least a lower pressure state and a higher pressure state. In the higher pressure state, a rigidifying material disposed within the chamber can be relatively flexible, and in the lower pressure state the rigidifying material can be relatively less flexible than in the higher pressure state. A layer can be formed into a desired shape by forcing the layer against a target surface to take on the desired shape that can be substantially a match of the target surface with the chamber in the higher pressure state. The method can modify a flexibility of the layer of the first portion to maintain the desired shape of the layer by changing a flexibility of the rigidifying material.

This overview is intended to provide an overview of subject matter of the present patent application. It is not intended to provide an exclusive or exhaustive explanation of the invention. The detailed description is included to provide further information about the present patent application.

Figure 1:
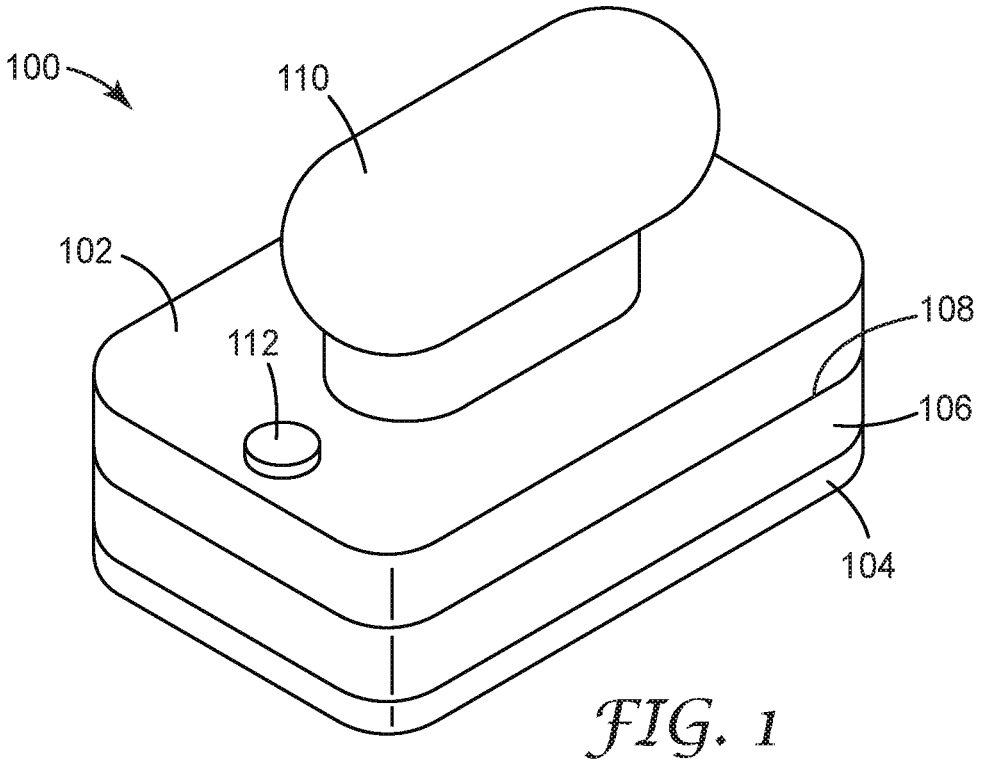
FIG. 1 is a perspective view of apparatus of the present disclosure having a body and a formable first portion according to one embodiment of the present disclosure.
Figure 1A:
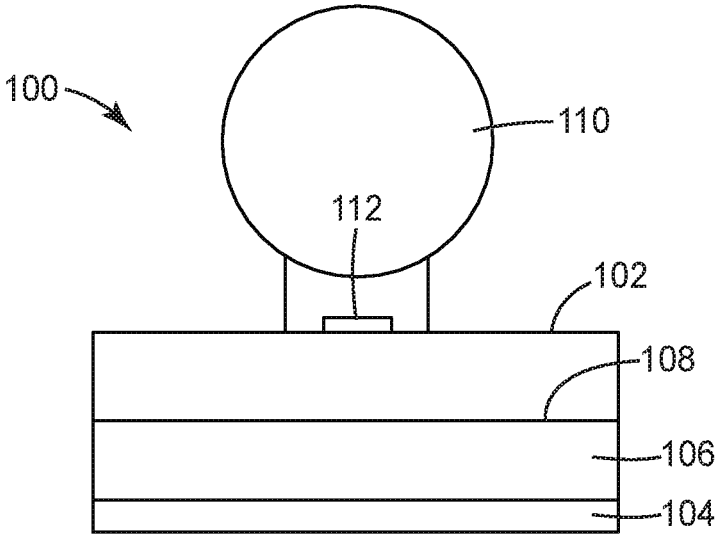
FIG. 1A is a plan view of the apparatus of FIG. 1.

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present disclosure generally relates to apparatuses and methods for capturing a desired shape of a target surface (e.g., by contacting a first portion of the apparatus against the target surface with the first portion in a flexible state that can conform to the target surface) and for holding the desired shape for use in the variety of applications. As such, the present disclosure is generally directed to apparatuses and related methods that can utilize a shape-formable layer and other shape-formable structures (e.g., a rigidifying material).

According to some exemplary embodiments, the rigidifying material can comprise a fibrous material or a plurality of locking sheets. However, strips of thin sheets and discrete particles of a bulk media, or the like are also contemplated. Each locking sheet can be patterned into solid regions and open regions (i.e., gaps or spaces between solid regions), such that at least some of the solid regions can move relative to one another within a major surface of the sheet. This structure can allow for shape manipulation including manipulation of one or more layers directly or indirectly connected to the rigidifying material. With use of the rigidifying material, the first portion can have a first state in which the first portion is formable and is able to be changed into a desired shape (in one or more directions). For example, the first portion can be positioned against the target surface such that the first portion can conform to the target surface. The first portion can be further configured to be changed from the first state into a second state in which the shape of the first portion can be substantially fixed or rigid (or at least substantially less formable or more rigid than in the first state), such that the formed shape can be maintained for a desired purpose (e.g., sanding, filling, smoothing, molding, or the like).

According to one example embodiment, the first portion can be changed from the first state to the second state by evacuating a chamber, which houses the rigidifying material, to reduce the pressure in the chamber to a lower pressure state (e.g., a pressure below ambient pressure). The first portion can be changed from the second state back to the first state by releasing the reduced pressure in the chamber and allowing it to return to a higher pressure state (e.g. ambient pressure). The first portion can include an opening or a port that provides fluid communication between the chamber and ambience, in one embodiment. Additionally, the port can provide fluid communication such as with a vacuum source that can be coupled to the port via a connector (e.g., tubing).

As discussed previously, the apparatuses of the present disclosure can be used for a variety of applications that can benefit from a material or article that can be changed from a formable state, in which it can be formed into a desired shape, to a rigid or non-formable state, in which the desired shape can be essentially locked for as long as desired. Examples of such applications, include, but are not limited to, sanding, filling, smoothing, molding, or the like.

Methods of using apparatuses that utilize a rigidifying material and the configuration thereof are described in U.S. Provisional Application Nos. 62/094,299, 62/094,336, 62/094,279, and 62/094,240, which are each incorporated herein by reference in their entirety.

The present devices can be constructed to be more effective for applications including sanding, filling, smoothing, and molding, for example. According to one embodiment, the apparatus can be configured to urge the first portion to conform to the desired shape of the target surface. This can be accomplished by a second portion of the apparatus that can be disposed between the body and the first portion. The second portion can comprise one or more of a foam, a layered foam, a bladder filled with a fluid, a volume (e.g., a void) configured to be accessible to an implement or tool, a volume (e.g., a void) configured to be accessible to a human hand, and a plurality of urging elements, for example. According to further embodiments, the apparatus can be configured to stiffen the first portion of the apparatus along at least one axis thereof, the stiffening can occur relative to the body, for example. Such stiffening can be facilitated by particular rigidifying material configurations disclosed herein, for example. Stiffening can also be accomplished by various configurations of the apparatus disclosed herein. Stiffening the first portion can be desirable to apply sufficient force onto a target surface to perform applications such as sanding, for example. Further embodiments contemplate that the apparatus can be configured for sanding with an abrasive layer disposed on and secured to the first portion. In some embodiments, the apparatus can be configured to vibrate the first portion to increase the effectiveness of the sanding. Further embodiments are disclosed with features to facilitate filling, smoothing, and/or molding, for example.

Definitions

The term "a", "an", and "the" are used interchangeably with "at least one" to mean one or more of the elements being described.

The term "and/or" means either or both. For example "A and/or B" means only A, only B, or both A and B.

The terms "including," "comprising," or "having," and variations thereof, are meant to encompass the items listed thereafter and equivalents thereof as well as additional items.

Unless specified or limited otherwise, the term "coupled" and variations thereof are used broadly and encompass both direct and indirect couplings.

The terms "front," "rear," "top," "bottom," and the like are only used to describe elements as they relate to one another, but are in no way meant to recite specific orientations of the apparatus, to indicate or imply necessary or required orientations of the apparatus, or to specify how the invention described herein will be used, mounted, displayed, or positioned in use.

A "low friction" surface can generally be used to refer to a surface having a low kinetic coefficient of friction. In some embodiments, a low friction surface can include a kinetic coefficient of friction of no greater than about 1, in some embodiments, no greater than about 0.5, and in some embodiments, no greater than about 0.25, when measured on a flat film, sliding against another piece of the same material in accordance with ASTM D1894-08 Static and Kinetic Coefficients of Friction of Plastic Film and Sheeting.

A "high friction" surface can generally be used to refer to a surface having a high kinetic coefficient of friction, e.g., when describing a locking sheet alone or relative movement between locking sheets when the apparatus is in the first state. This friction can be achieved through properties of the surface material, or through physical structuring of the surface (e.g. 3M™ Gripping Material, available from 3M Company, St. Paul, Minn.; www.3 m.com/gripping). In some embodiments, a high friction surface can include a kinetic coefficient of friction of at least about 1, in some embodiments, at least about 3, and in some embodiments, at least about 10, when measured on a flat film, sliding against another piece of the same material in accordance with ASTM D1894-08 Static and Kinetic Coefficients of Friction of Plastic Film and Sheeting.

The phrases "sheet," "sheet-like," "sheet-like configuration," "plate," "plate-like," "plate-like configuration," or variations thereof, are used to describe an article having a thickness that is small relative to its length and width. The length and width of such articles can define a "major surface" of the article, but this major surface, as well as the article, need not be flat or planar. For example, the above phrases can be used to describe an article having a first ratio ($R_1$) of thickness (e.g., in a Z direction that is orthogonal to a major surface of the article at any point along the major surface) to a first surface dimension of the major surface (e.g., width or length), and a second ratio ($R_2$) of thickness to a second surface dimension of the major surface, where the first ratio ($R_1$) and the second ratio ($R_2$) are both less than 0.1. In some embodiments, the first ratio ($R_1$) and the second ratio ($R_2$) can be less than 0.01; in some embodiments, less than 0.001; and in some embodiments, less than 0.0001. Note that the two surface dimensions need not be the same, and the first ratio ($R_1$) and the second ratio ($R_2$) need not be the same, in order for both the first ratio ($R_1$) and the second ratio ($R_2$) to fall within the desired range. In addition, none of the first surface dimension, the second surface dimension, the thickness, the first ratio ($R_1$), and the second ratio ($R_2$) need to be constant in order for both the first ratio ($R_1$) and the second ratio ($R_2$) to fall within the desired range.

The phrase "layer" is used to describe an article of the first portion that is manipulatable by the rigidifying material. In some cases, the layer can have a thickness that is small relative to its length and width although such structure is not necessarily needed. The layer need not be flat or planar. The layer can be the envelope, part of the envelope, an article adjacent the rigidifying material that is connected indirectly or directly thereto, an externally interfacing surface of the first portion, or an intermediate layer coated or otherwise covered with various materials or additional layers, which can form the externally interfacing surface or another layer of the first portion, for example.

The phrase "rigidifying material" is used to refer to any one or combination of materials such as thin sheets, fibers, strips of thin sheets, discrete particles of a bulk media, or the like described herein having the capability to change between a more rigid state and a relatively less rigid state. Such materials can be further defined herein and/or can have a meaning that is readily ascertainable to one of ordinary skill in the art.

The phrase "lower pressure state" as used herein connotes a pressure which is relatively lower than a "higher pressure state". According to some embodiments, the lower pressure state can be a pressure below ambient pressure. Such pressure can comprise a pressure below ambient pressure by between about 4 psi to about 13 psi according to further embodiments.

The phrase "higher pressure state" as used herein connotes a pressure which is relatively higher than the "lower pressure state". According to some embodiments, the higher pressure state can be a pressure of about ambient pressure. Such pressure can comprise a pressure that varies from ambient pressure by between about −2 psi to about 2 psi according to further embodiments.

The phrase "major surface" is used to refer to a collective surface of an article (e.g., an outer surface of the article), even if the article is formed of smaller objects or portions. The smaller objects and portions can collectively define a major surface of the article. While such a major surface can be planar in some instances, the major surface need not be flat or planar, and in some cases, can be curved or otherwise complex. The phrase "major surface" is described in greater detail below with respect to the locking sheets.

The phrase "substantially parallel" is used to refer to the relative orientation of at least two axes or at least two sheets or sheet-like articles having a major surface, where the major surface of the sheets or articles are oriented parallel with respect to one another at any point along their respective major surfaces, but allowing for a slight deviation from parallel. For example, if two sheets have major surfaces that lie in an X-Y plane and are spaced a distance apart in a Z direction that is orthogonal, or normal, to the X-Y plane, the two sheets can be considered substantially parallel even if one or both of the sheets has a major surface that is oriented slightly out of an orthogonal relationship with the Z direction at a given point, or area, along the major surface. In some embodiments, the two sheets can be substantially parallel if one or both of the sheets has a major surface that extends in the Z direction by an amount (i.e., has a Z dimension because the major surface is tilted with respect to the Z direction) that is no greater than 10% of its dimensions in the X-Y plane; in some embodiments, no greater than 5%; in some embodiments, no greater than 2%; and in some embodiments, no greater than 1%. Note that two sheets can still be substantially parallel even if the sheets are not flat or planar. For example, two curved sheets can be substantially parallel if the two sheets are curved to the same degree and in the same way so that the orientation of the major surfaces of the two sheets, relative to a normal direction at any point, or area, along the major surface, still falls within the above ranges.

The terms "polymer" and "polymeric material" refer to both materials prepared from one monomer such as a homopolymer or to materials prepared from two or more monomers such as a copolymer, terpolymer, or the like. The terms "copolymer" and "copolymeric material" refer to a polymeric material prepared from at least two monomers.

The terms "room temperature" and "ambient temperature" are used interchangeably to mean a temperature in the range of 20° C. to 25° C.

Figure 1B:
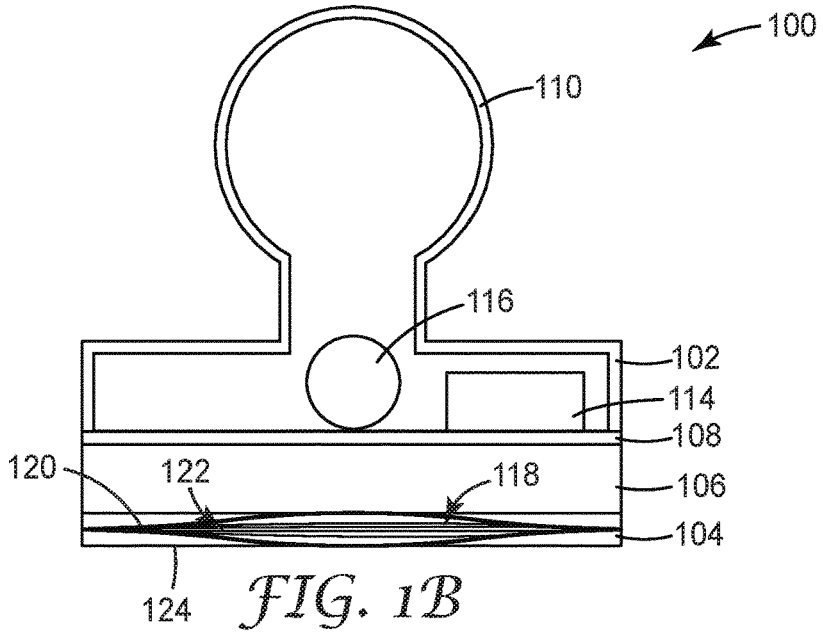
FIG. 1B is cross-sectional view of the apparatus of FIG. 1A including the body and the first portion.

FIGS. 1 to 1B illustrate an apparatus 100 according to one embodiment of the present disclosure. The apparatus 100 can comprise a copy block as will be further described herein. The apparatus 100 can include a body 102, a first portion 104, and a second portion 106. The body 102 can include a base 108 according to the illustrated embodiment. The body 102 can include a handle 110 and an actuator 112. As shown in FIG. 1B, the apparatus 100 can house or otherwise couple with one or more additional devices such as a power source 114 (e.g., a battery) and a vacuum device 116.

In the embodiment of FIGS. 1 to 1B, the base 108 of the body 102 can be connected to the second portion 106. The second portion 106 can connect to the first portion 104 and can indirectly (e.g., through intermediate layers or elements) or directly connect with the body 102. Thus, the second portion 106 can be arranged intermediate of the first portion 104 and the body 102. The first portion 104 can be coupled (directly or indirectly as shown in the embodiment of FIGS. 1 to 1B) to the body 102 and can be movable therewith.

The first portion 104 can comprise a distal-most portion of the apparatus 100, and can include various articles that will be discussed in further detail subsequently. According to the embodiment of FIGS. 1 to 1B, the body 102 can comprise a proximal-most portion of the apparatus 100. The handle 110 can extend proximally from the body 102 and can be configured to be graspable by a hand of a user. Thus, the apparatus 102 can be handheld and can be manipulated by the user for various applications according to some embodiments.

In the embodiment of FIGS. 1 to 1B, the actuator 112 (e.g., a switch) can be actuated by the user to control operation of the vacuum device 116 by supplying or removing the supply of power to or from the power source 114. In operation, the vacuum device 116 can act to reduce pressure within a chamber of the first portion 104 as will be described subsequently. According to other embodiments, the actuator, power source, vacuum device and/or other components can be remote from the apparatus. For example, a tether (e.g., a vacuum line) can be used to supply a vacuum to the first portion 104. Similarly, power can be provided via cabling, through energy harvesting techniques, or other methods. According to a further embodiment, the vacuum device may not be electrically powered, but instead may be operated by a hand actuated device such a hand vacuum pump, for example.

The body 102 can comprise a rigid or substantially rigid (semi-rigid) material such a plastics material, an alloy, a composite, or the like. According to some embodiments, the base portion 108 can be part of the body 102. The weight of the body 102 can vary depending upon the application for which the apparatus 100 is being used (along with other factors including the amount or use of a force applied to the user by the apparatus 100, the location of the vacuum or power source, for example). The second portion 106 can comprise a deformable foam according to the embodiment of FIGS. 1 to 1B. However, the second portion 106 can comprise one or more of the foam, a layered foam, a bladder filled with a fluid, a volume (e.g., a void) configured to be accessible to an implement, a volume (e.g., a void) configured to be accessible to a human hand, and a plurality of urging elements according to further embodiments. The second portion 106 can be deformable, but also has the ability to return to substantially an un-deformed shape as shown in FIGS. 1 to 1B. Additionally, the second portion 106 can supply an urging force to the first portion 104 that allows the first portion 104 to conform to a desired shape of a target surface in a more desirable manner. This can allow intricacies, details and/or features of the target surface to be captured by the first portion with better detail.

As has been discussed previously, the first portion 104 can have a first state in which the first portion 104 is formable and is able to be changed into a desired shape (in one or more directions). For example, the first portion 104 can be disposed against a target surface such that the first portion 104 can conform to the target surface. The first portion 104 can be further configured to be changed from the first state into a second state in which the shape of the first portion 104 can be substantially fixed or rigid (or at least substantially less formable or more rigid than in the first state), such that the formed shape can be maintained for a desired purpose (e.g., sanding, filling, smoothing, molding, or the like).

As shown in FIG. 1B, the first portion 104 can include a rigidifying material 118, an envelope 120, a chamber 122 and a layer 124. More particularly, the rigidifying material 118 can be positioned in the chamber 122 defined by the envelope 120. The envelope 120 can be constructed of a gas-impermeable material. The layer 124 can be manipulatable by the rigidifying material 118. The layer 124 is illustrated as an exterior interfacing surface of the first portion 104 in the embodiment of FIGS. 1 to 1B. According to further embodiments, the layer 124 can be the envelope, part of the envelope, an article adjacent the rigidifying material 118 that is connected indirectly or directly thereto, or an intermediate layer coated or otherwise covered with various materials or layers, which can form the externally interfacing surface or another layer of the first portion, for example.

As will be described in further detail subsequently, a pressure within the chamber 122 can be varied between at least a lower pressure state and a higher pressure state. In the higher pressure state, the rigidifying material 118 can be relatively flexible, and in the lower pressure state the rigidifying material 118 is relatively less flexible than in the higher pressure state. The layer 124 can have a first state when the pressure within the chamber 122 is in the higher pressure state. In the first state, the layer 124 is formable by the target surface to take on a desired shape that is substantially a match of the target surface. The layer 124 can have a second state when the pressure within the chamber 122 is in the lower pressure state. In the second state, the layer 124 maintains the desired shape and is substantially less formable than in the first state.

FIGS. 2A, 2B, 2C, 2D and 2E show the rigidifying material 118, the envelope 120, and the chamber 122 in further detail undergoing a process where the rigidity of the rigidifying material 118 is altered by changing the pressure within the chamber 122. FIGS. 2A, 2B, 2C, 2D and 2E further illustrate a vacuum device 126 and a port 128. The vacuum device 126 can communicate with the chamber 122 via the port 128. The port 128 can additionally communicate selectively with the ambient environment according to some embodiments.

Figure 2A:
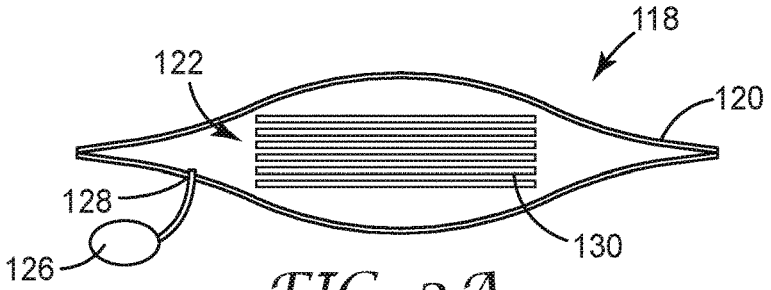
FIG. 2A to 2C show elements of the first portion according to one embodiment showing a rigidifying material comprising overlapping sheets disposed in a gas-impermeable envelope.
Figure 2B:
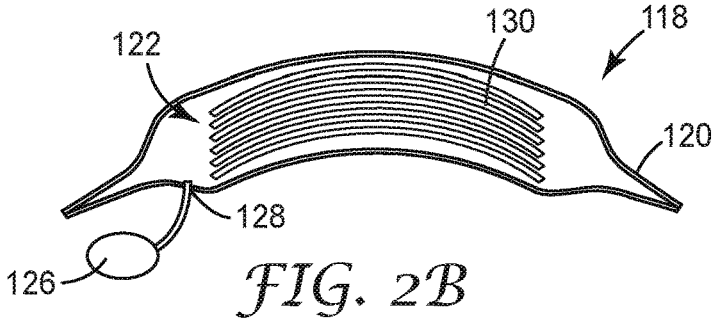
Figure 2C:
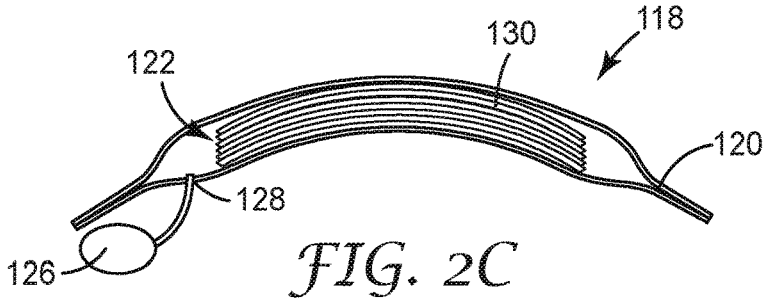
Figure 2D:
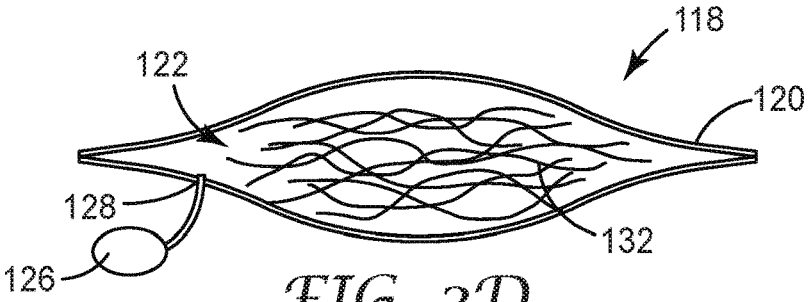
FIGS. 2D and 2E show elements of the first portion according to another embodiment where the rigidifying material comprises fibers disposed in the gas-impermeable envelope.

As shown in FIGS. 2A and 2D, the pressure within the chamber 122 can be in the higher pressure state (e.g., at or near ambient). In this condition, the sheets 130 (FIG. 2A) and the fibers 132 (FIG. 2D) can experience a relatively low friction force with respect to one another. Thus, relative movement of the sheets 130 (FIG. 2A) and the fibers 132 (FIG. 2D) can be possible and the rigidifying material can be relatively flexible (or at least relatively more flexible than in the lower pressure state). FIG. 2B shows the rigidifying material being held in a desired shape. The application of some force is required to change the shape from FIG. 2A to FIG. 2B. Its shape can be more easily changed because it is in the higher pressure state. FIG. 2C shows the chamber at a lower pressure state where the rigidifying material is held in the shape that was imposed on it in FIG. 2B. The forces used to shape the rigidifying material in FIG. 2B can be removed and the rigidifying material in FIG. 2C will hold its shape and even resist forces that try to reshape it.

Figure 2E:
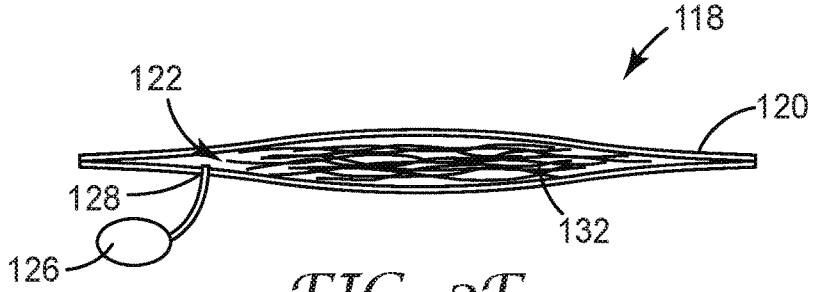

FIGS. 2C and 2E show the chamber 122 with the pressure in the lower pressure state. In this lower pressure state, a greater degree of friction force occurs between the sheets 130 and the fibers 132 relative to the higher pressure state. Thus, relative movement of the sheets 130 (FIG. 2A) and the fibers 132 (FIG. 2D) can be difficult and the rigidifying material can be relatively inflexible (or at least relatively less flexible than in the higher pressure state). Further details regarding interaction and construction of the sheets and fibers and other articles will be discussed in greater detail subsequently. It is intended that FIGS. 2A to 2D (and indeed FIGS. 1-4) provide a high level introduction to the some of the apparatuses, methods and potential applications discussed herein.

Figure 3:
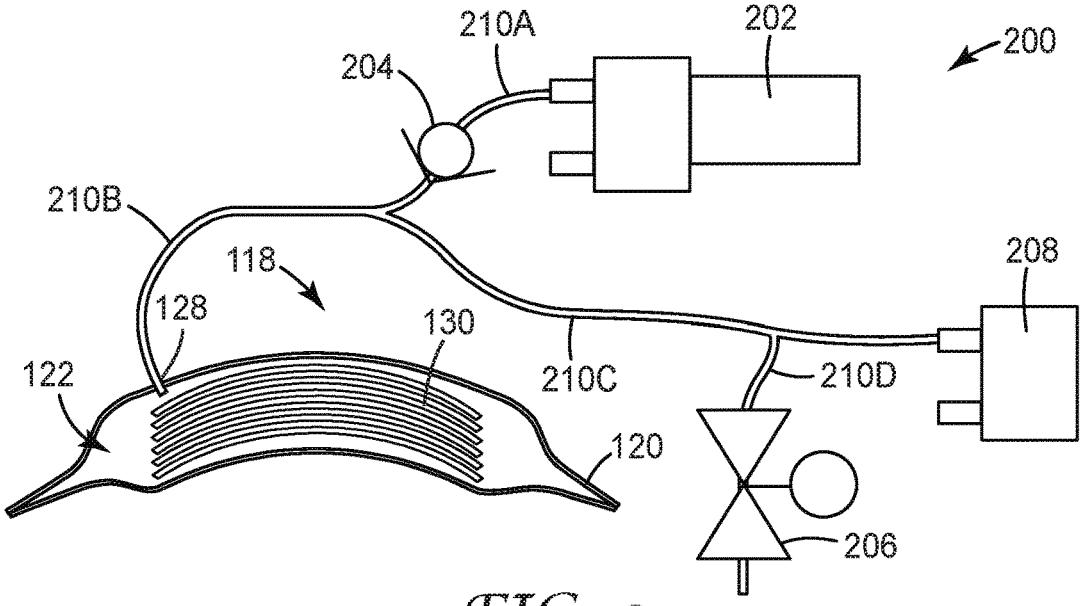
FIG. 3 is schematic diagram of a pneumatic system according to one embodiment of the present disclosure that includes the envelope and the rigidifying material.

FIG. 3 shows a diagram of a pneumatic system 200 according to one embodiment. The system 200 can include a vacuum device 202, a check valve 204, a second valve 206, a pressure sensor 208 and communication lines 210A, 210B, 210C and 210D. The system 200 can additionally include the rigidifying material 118, the envelope 120, the chamber 122, and the port 128 previously discussed in reference to FIGS. 2A to 2E.

The vacuum device 202 can fluidly communicate with the chamber 122 via the communication lines 210A and 210B and the port 128. The check valve 204 can be positioned along communication line 210A. The communication line 210C can extend to pressure sensor 208 and the communication line 210D can extend from 210C to the second valve 206. Thus, fluid, such as air, can communicate between the pressure sensor 208 and the chamber 122.

In operation, the vacuum device 202 (e.g., a pump or venturi) can act to selectively remove a pressure from the chamber 122. The check valve 204 can operate to reduce or eliminate a leakage of air back to the vacuum device 202 when the vacuum device 202 is not operational. The second valve 206 (e.g. a solenoid valve or the like) can be operable to selectively open to allow an ambient pressure to enter the system 200 and pressurize the chamber 122 (e.g., to the higher pressure state). The pressure sensor 208 can be operable to monitor pressure within the system 200 (e.g., within the chamber 122) and can be used to control the operation of the vacuum device 202. For example, if the pressure sensor 208 detects a higher pressure than is desired, the vacuum pump 202 can be activated to operate and reduce the pressure within the system 200.

Figure 4:
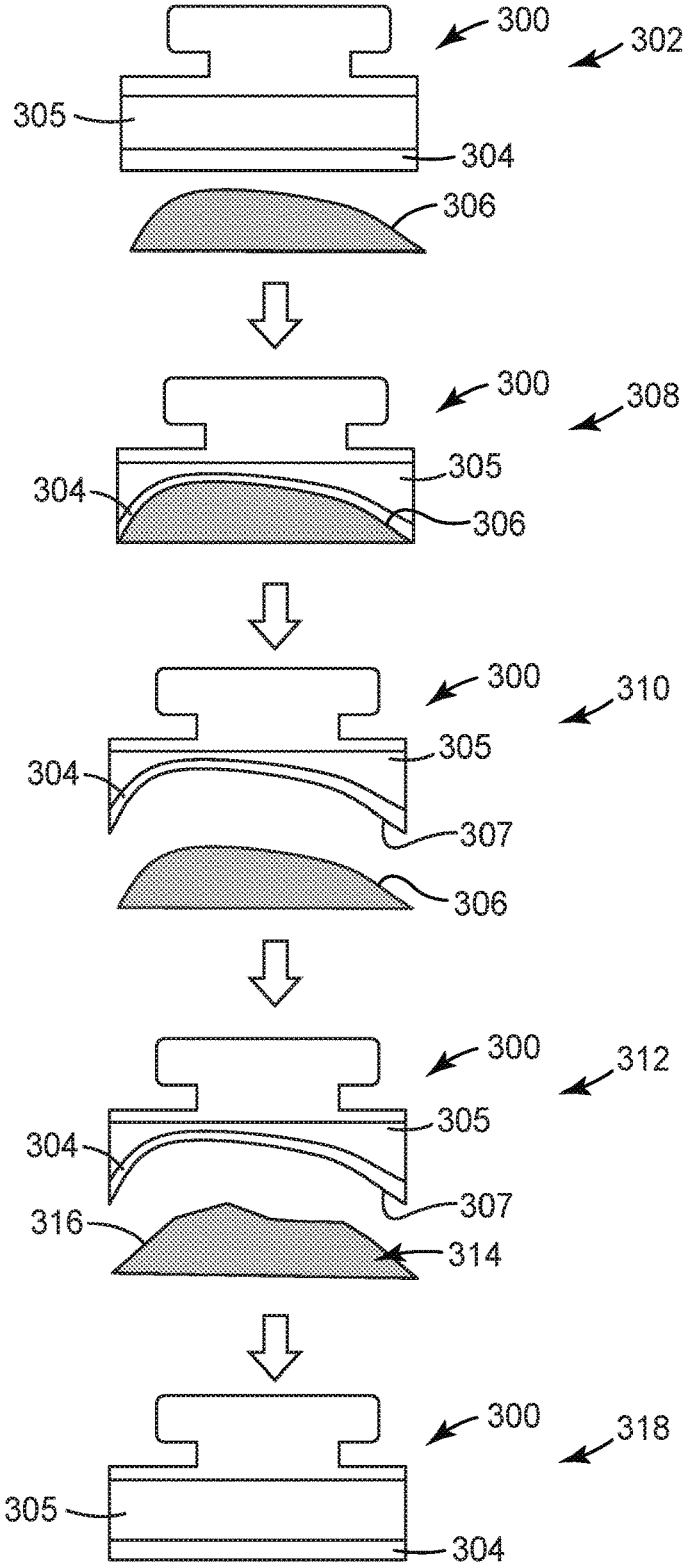
FIG. 4 is a diagram of a method of utilizing the apparatus to copy a shape and then to hold that copied shape and utilize it for one of various applications discussed herein.

FIG. 4 shows a diagram of a method of using the apparatuses discussed herein according to one embodiment. More particularly, the diagram of FIG. 4 shows an apparatus 300 being used as a copy block. The method can include a step 302 where a vacuum device is not activated such that the first portion 304 can be relatively conformal and able to take on a desired shape. The step 302 illustrates the first portion 304 has not yet been brought into contact with the target surface 306. In step 308, the first portion 304 has been forced against the target surface 306 and the first portion 304 takes on a desired shape 307 (substantially that of the target surface 306). With the apparatus 300 abutting against the target surface 306, the vacuum device can be activated as previously discussed to provide for the lower pressure state, in which the shape of the first portion can rigidify in the desired shape 307. As shown in step 308, in some embodiments the second portion 305 of the apparatus can deform as well with deformation of the first portion 304.

Step 310 shows the apparatus 300 removed from the target surface 306 but with the first portion 304 still held in the desired shape 307 which can be substantially a copy of the target surface 306. The desired shape 307 is maintained as long as the vacuum device is activated to provide for the lower pressure state. As shown in step 312, the apparatus 300 can be brought into contact with another object 314 having a surface profile 316. Prior to such contact, the vacuum device can be deactivated as desired so as to return the first portion 304 to a manipulatable shape (skipping to step 318). However, according to other embodiments the vacuum device may still be operable to hold the first portion 304 in the desired shape 307 upon contact. For example, in a sanding application the first portion 304 can be held in the desired shape 307 and the first portion 304 can be moved along the object 314 thereby removing portions of the surface profile 316 such that the surface profile 316 more closely conform to that of the desired shape 307. In step 318, the vacuum device is de-activated and the first portion 304 of the apparatus 300 are again returned to a state of being relatively conformal and can be used again to take on a desired shape in the manner previously described.

Figure 5:
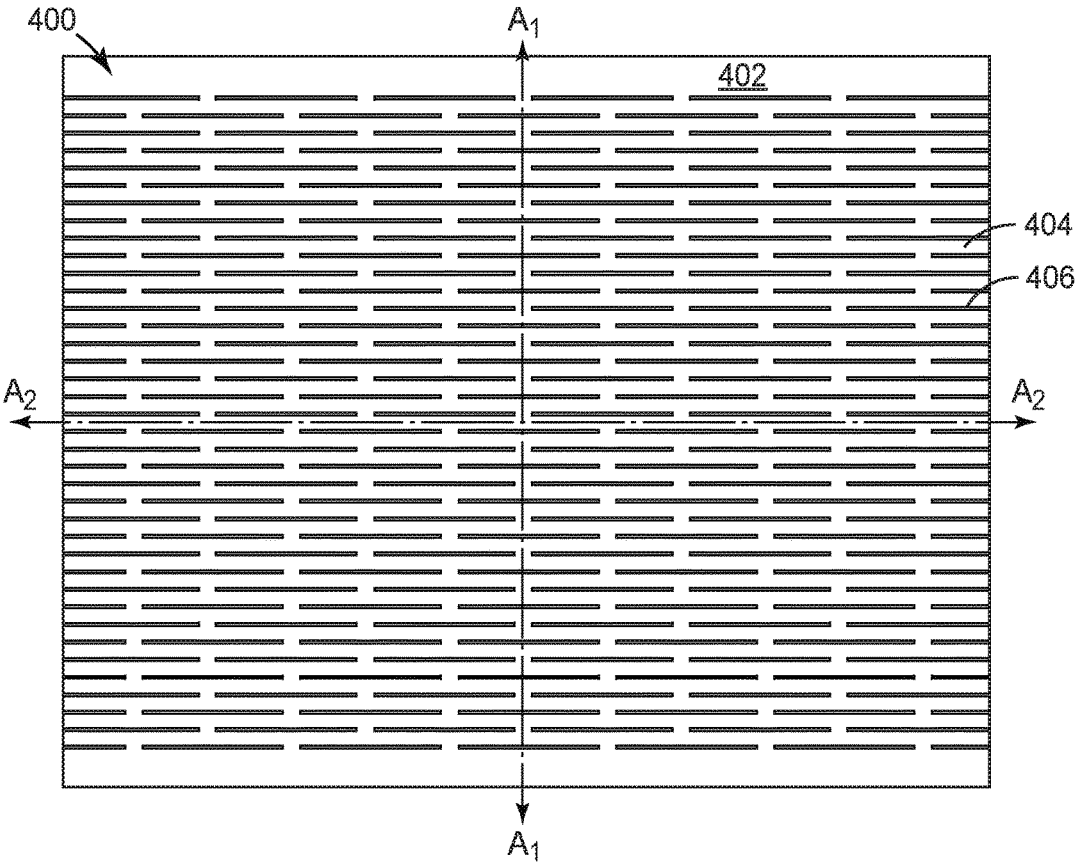
FIG. 5 is top plan view of a sheet configuration where the sheet is patterned to include solid regions and void regions according to one embodiment of the present disclosure.
Figure 5A:
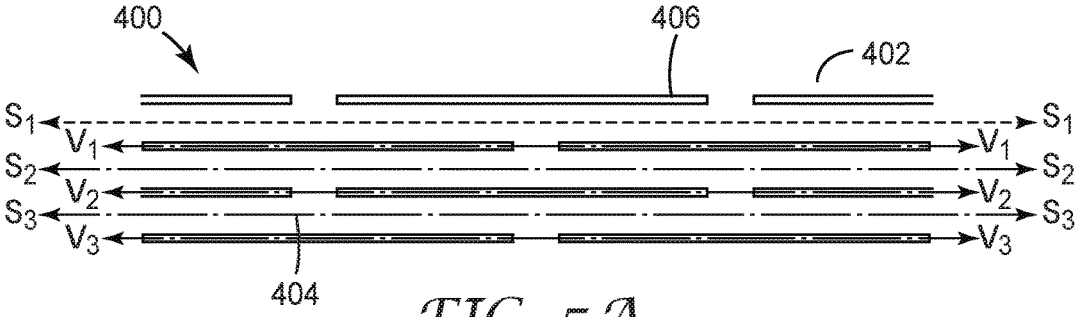
FIG. 5A is an enlargement of the sheet configuration of FIG. 5 showing the solid regions can extend uninterrupted along axes that are generally parallel with one another and the void regions can extend along axes that generally parallel with one another and are generally oriented to extend parallel with the axes of the solid regions.

FIGS. 5 and 5A show a pattern that can be used for a rigidifying material such as a sheet 400 according to one embodiment. The sheet 400 can be used in instances where it may be desired for the layer (e.g., layer 124 of FIGS. 1 to 1B) of the first portion (e.g., 104, 304) to be deformable only in a direction substantially orthogonal to a single axis. Thus, the sheet 400 can be used to create a desired profile pattern for the first portion and the layer.

In FIGS. 5 and 5A, the sheet 400 includes a major surface 402 and at least a portion of the sheet 400 can be patterned to include solid regions 404 and void regions 406. The solid regions 404 can be movable with respect to one another within the major surface 402 as will be discussed in further detail subsequently. Thus, the sheet 400 can be cut into a pattern that allows the sheet 400 to be extendable with respect to at least one axis $A_1$, but the pattern can allow the sheet 400 to be relatively non-extendable (relatively rigid) along a second axis $A_2$ to better convey a force in that direction.

FIG. 5A shows an enlarged view of a portion of the sheet 400. In FIG. 5A, the solid regions 404 can extend generally uninterrupted along axes $S_1$, $S_2$, $S_3$ that are generally parallel with one another. The void regions 406 can extend along axes $V_1$, $V_2$, $V_3$ that can be generally parallel with one another. The axes $V_1$, $V_2$, $V_3$ of the void regions 406 can be oriented to extend generally parallel with the axes $S_1$, $S_2$, $S_3$ of the solid regions 404. As shown in the embodiment of FIGS. 5 and 5A, the axes $S_1$, $S_2$, $S_3$ can be oriented to generally align with the second axis $A_2$ to allow the sheet 400 to convey force in that direction.

Figure 6:
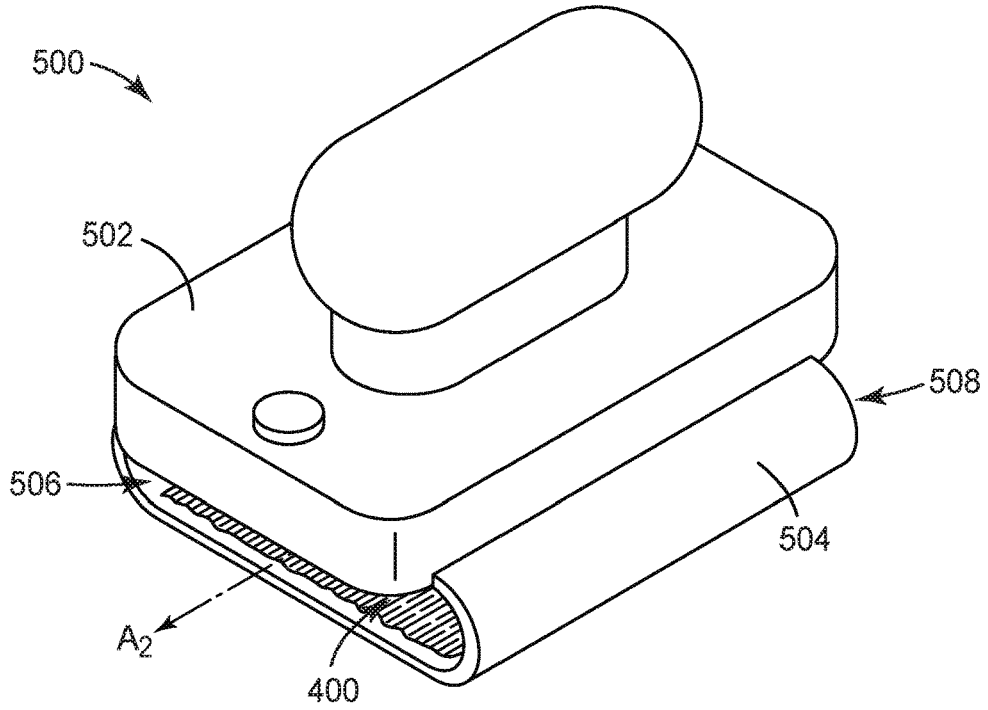
FIG. 6 is a perspective view of an apparatus of the present disclosure having a body and a formable first portion that is provided with additional stiffness along at least one axis by coupling one or more edges of the first portion back with the body according to one embodiment of the present disclosure.

FIG. 6 shows the sheet 400 superimposed on another embodiment of the apparatus 500. The apparatus 500 can have a body 502 and a first portion 504 constructed in a manner similar to that of the body 102 and the first portion 104 of the apparatus 100 of FIGS. 1 to 1B. Thus, specific illustration and details regarding various articles previously discussed with respect to the embodiment of FIGS. 1 to 1B including the chamber, the envelope and the layer, for example, are not provided with respect to the apparatus 500 of FIGS. 6 and 6A.

FIG. 6 shows a cutaway of a proximal part of the first portion 504 showing the orientation of the sheet 400 therein. As discussed previously, the pattern of void regions and solid regions can allow the sheet 400 to be relatively non-extendable (relatively rigid) along a second axis $A_2$ to better convey a force in that direction. Thus, the first portion 504 (and layer 524 of FIG. 6A) can be relatively rigid along the second axis $A_2$ and can convey a force in that direction. This can allow for sanding or another application to be carried out along the second axis $A_2$, for example. Therefore, with the use of the sheet(s) 400 the first portion 504 (including the layer 524 of FIG. 6A) can be configured to be formable against a target surface only in a plane orthogonal to the axis $A_2$, which is the plane shown in the view of FIG. 6A. According to further embodiments, such as those previously discussed and those that will be discussed subsequently, the first portion 504 can utilize different rigidifying materials (fibers, sheets with a different pattern, or the like), and therefore, the first portion 504 (including the layer 524) can be configured to be flexible and formable against the target surface along a plurality of axes of the first portion 504 which are different than or in addition to the plane orthogonal to axis A2.

Figure 6A:
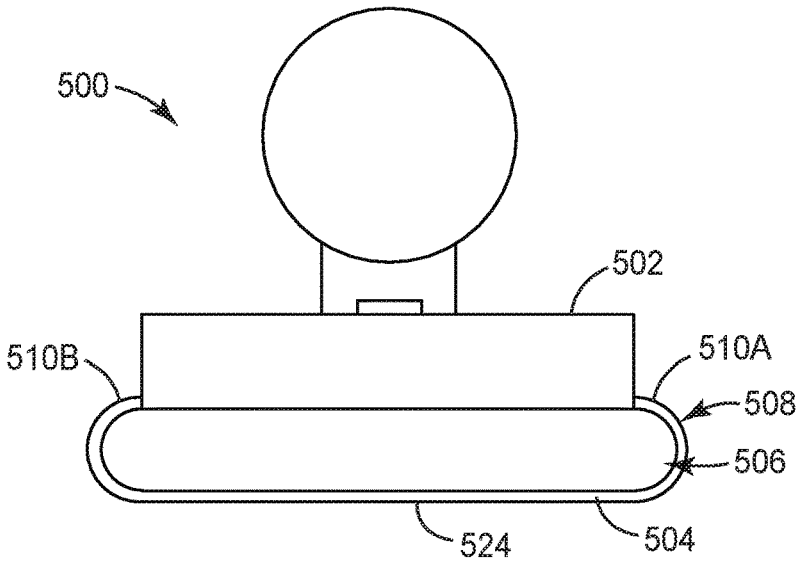
FIG. 6A is a plan view of the apparatus of FIG. 6 and further illustrating a second portion of the apparatus in addition to the body and the first portion.

FIGS. 6 and 6A also illustrate an embodiment of the apparatus 500 where a second portion 506 can be configured as a volume (a void) so that the second portion 506 can be accessible to an implement or to a human hand. With a void comprising the second portion 506, the first portion 504 can be accessed and urged against a target surface with a force supplied by the implement or the human hand. This force can be used to allow the first portion 504 and the layer 524 (FIG. 6A) to conform to the target surface such as to better capture specific details of the target surface.

FIGS. 6 and 6A additionally illustrate an embodiment of the apparatus 500 where the apparatus 500 includes a stiffening configuration 508 that can stiffen the first portion 504 and the layer 524 (FIG. 6A) relative to the body 502 with respect to the plane orthogonal to axis $A_2$ of the first portion 504 and the layer 524 (FIG. 6A). More particularly, the stiffening configuration 508 can comprise a configuration where one or more edges 510A, 510B of the first portion 504 and the layer 524 (FIG. 6A) are coupled back to the body 502. The stiffening configuration 508 can allow for additional stiffening for force transfer to be carried out along another axis (e.g., the plane orthogonal to axis $A_2$), for example. Such an arrangement can be desirable in applications such as sanding where it is desirable to apply a force against the target surface to better facilitate material removal.

Figure 7:
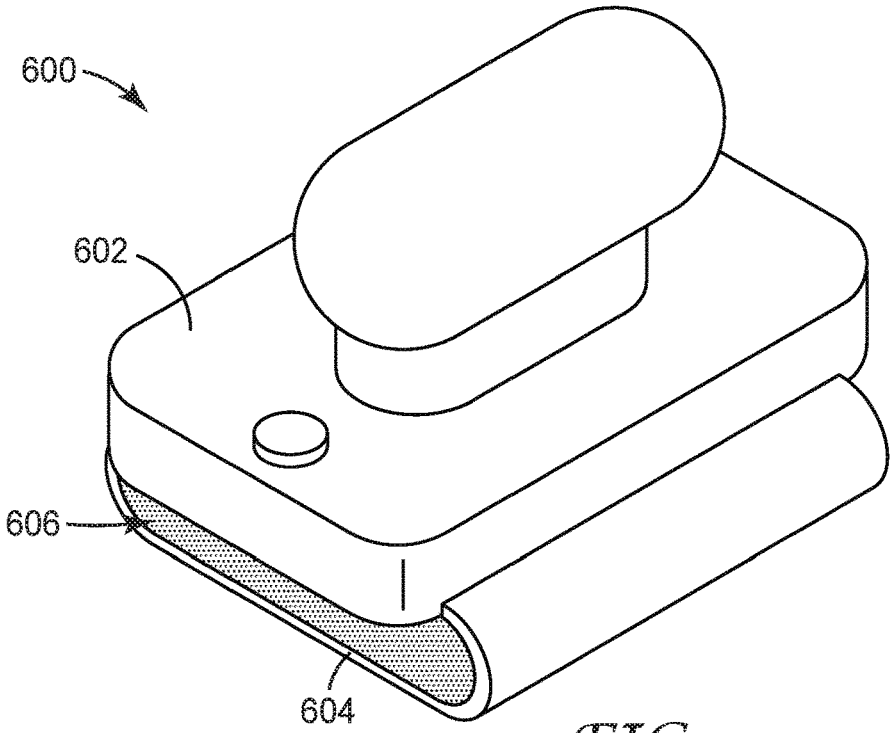
FIG. 7 is a perspective view of an apparatus of the present disclosure having a body and a formable first portion constructed in a manner similar to that of the embodiment of FIGS. 6 and 6A and additionally including the second portion filled with a material according to one embodiment of the present disclosure.
Figure 7A:
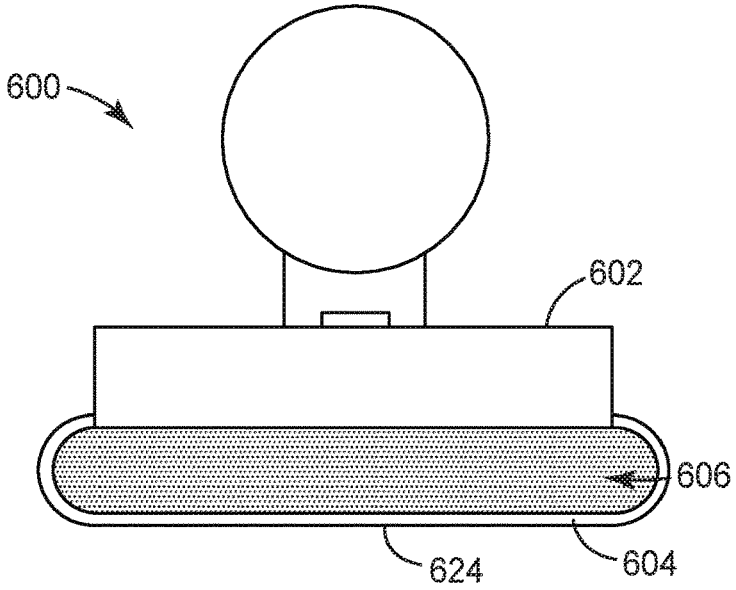
FIG. 7A is a plan view of the apparatus of FIG. 7.

FIGS. 7 and 7A show another embodiment of an apparatus 600. The apparatus 600 can be constructed in a manner similar to that of apparatuses 100 (FIGS. 1 to 1B) and 500 (FIGS. 6 and 6A). Thus, specific details regarding apparatus 600 will not be discussed in great detail with the understanding they have previously been discussed with respect to one of the previously disclosed embodiments.

The apparatus 600 can include a body 602, a first portion 604, and a second portion 606. The second portion 606 can comprise a bladder fillable with a fluid (e.g., air, a gel, water, or the like) that can apply a force on the first portion 604. With the fillable bladder comprising the second portion 606, the first portion 604 can be urged against a target surface with the force supplied by the bladder. This force can be used to allow the first portion 604 to conform to the target surface to better capture specific details of the target surface.

Figure 8:
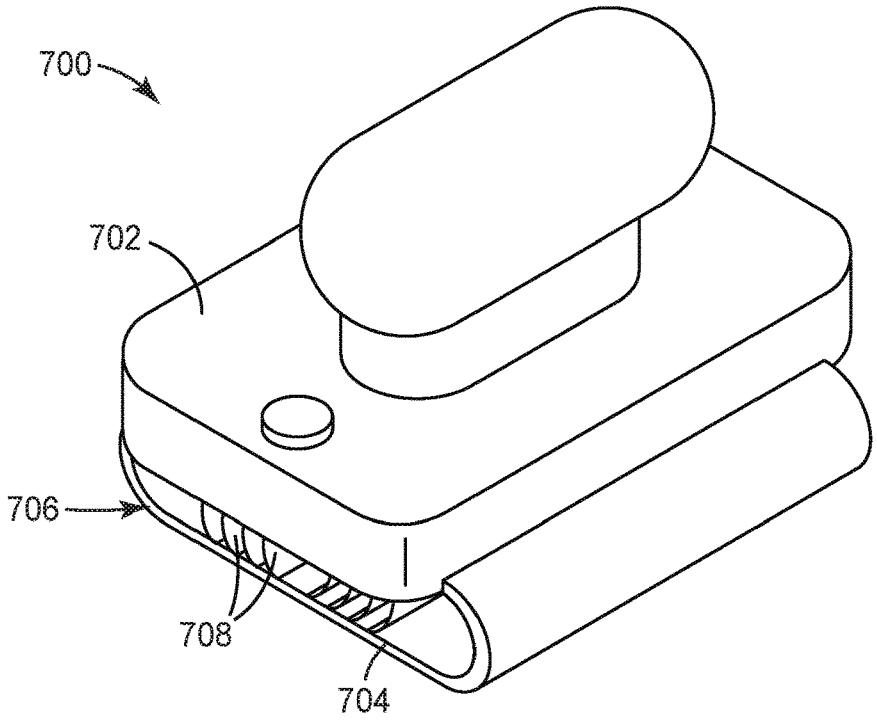
FIG. 8 is a perspective view of an apparatus of the present disclosure having a body and a formable first portion constructed in a manner similar to that of the embodiment of FIGS. 6 and 6A and additionally including elements that can stiffen and/or urge the first portion according to one embodiment of the present disclosure.
Figure 8A:
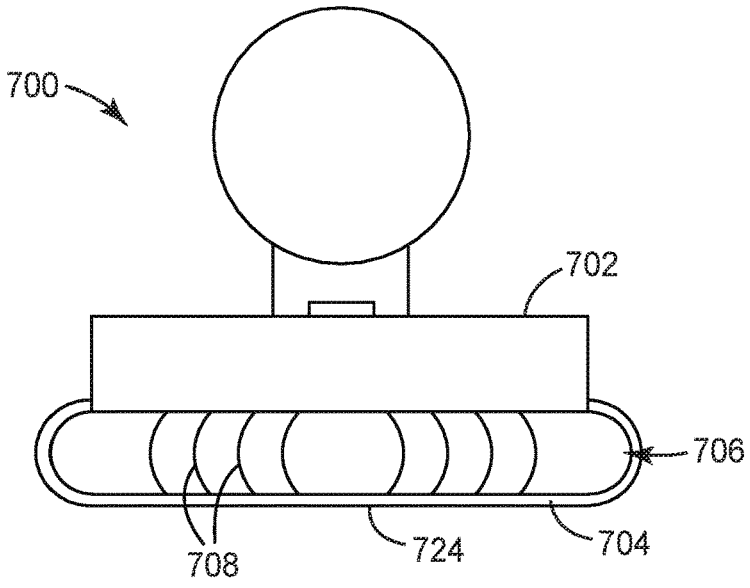
FIG. 8A is a plan view of the apparatus of FIG. 8.

FIGS. 8 and 8A show another embodiment of an apparatus 700. The apparatus 700 can be constructed in a manner similar to that of apparatuses previously discussed and illustrated. Thus, specific details regarding apparatus 700 will not be discussed in great detail with the understanding they have previously been discussed with respect to one of the previously disclosed embodiments.

The apparatus 700 can include a body 702, a first portion 704, a second portion 706 and elements 708. The elements 708 can comprise a part of the second portion 706. In particular, the elements 708 can be disposed within the second portion 706 and can extend between the body 702 and the first portion 704. In other embodiments, the elements 708 need not extend between the body 702 and the first portion 704. The elements 708 can comprise compression springs, thermoformed plastic sheets, fibers, or the like. The elements 708 can comprise stiffening elements (thus a part of a stiffening configuration) that stiffen the first portion 704 and the layer 724 (FIG. 8A) relative to the body 702 with respect to at least one axis (e.g., the axis $A_2$ of FIGS. 6 and 9) of the first portion 504 and the layer 524 (FIG. 8A). Such an arrangement can be desirable in applications such as sanding where it is desirable to apply a force against the target surface to better facilitate material removal.

Additionally, the elements 708 can comprise urging elements that can apply a force on the first portion 704. With the elements 708 included in the second portion 706, the first portion 704 can be urged against a target surface with the force supplied by the elements 708. This force can be used to allow the first portion 704 to conform to the target surface to better capture specific details of the target surface.

Figure 9:
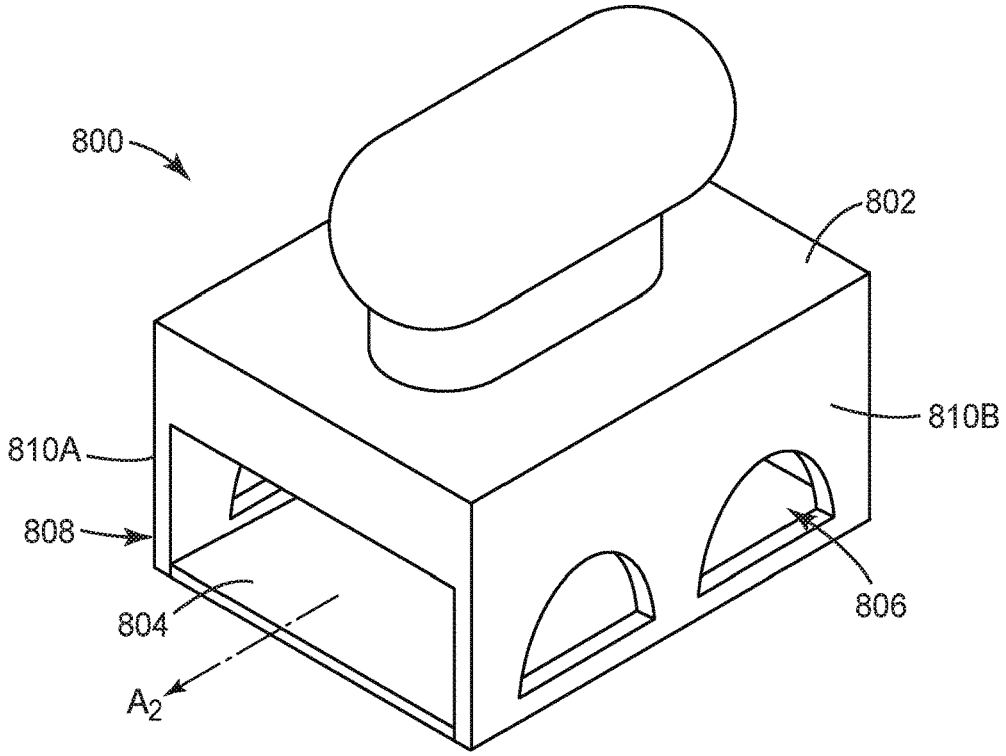
FIG. 9 is a perspective view of an apparatus of the present disclosure having a body and a formable first portion that is provided with additional stiffness along at least one axis by one or more members that extend from the body to couple with one or more edges of the first portion according to one embodiment of the present disclosure.
Figure 9A:
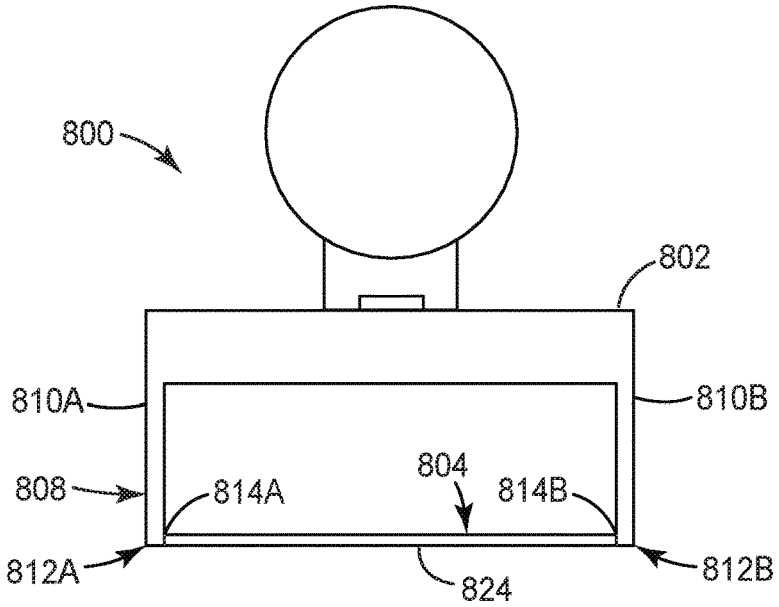
FIG. 9A is a plan view of the apparatus of FIG. 9.

FIGS. 9 and 9A show another embodiment of an apparatus 800. The apparatus 800 can be constructed in a manner similar to that of apparatuses previously discussed and illustrated. Thus, specific details regarding apparatus 800 will not be discussed in great detail with the understanding they have previously been discussed with respect to one of the previously disclosed embodiments.

The apparatus 800 can include a body 802, a first portion 804 and a second portion 806. The second portion 806 can be configured as a volume (a void) so that the second portion 806 can be accessible to an implement or to a human hand. With a void comprising the second portion 806, the first portion 804 can be accessed and urged against a target surface with a force supplied by the implement or the human hand. This force can be used to allow the first portion 804 and the layer 824 to conform to the target surface to better capture specific details of the target surface. For some target surfaces, for example a convex surface, the tension in the first portion caused by attachment to the leg supports 810A and 810B may be sufficient to cause the first portion to conform to the target surface.

Additionally, the apparatus 800 includes a stiffening configuration 808 that can stiffen the first portion 804 and the layer 824 (FIG. 9A) relative to the body 802 with respect to the axis $A_2$ of the first portion 804 and the layer 824 (FIG. 9A). More particularly, the stiffening configuration 808 can comprise a configuration where leg supports 810A, 810B extend from the body 802 distally to the first portion 804. As shown in FIG. 9A, the leg supports 810A, 810B are configured to retain one or more edges 812A, 812B of the first portion 804 and the layer 824 to the body 802. Thus, one or more edges 814A, 814B of the body 802 (e.g., the leg supports 810A, 810B) are coupled to the one or more edges 812A, 812B of the first portion 804 and the layer 824. The stiffening configuration 808 can allow for additional stiffening for force transfer to be carried out along the axis $A_2$, for example. Such an arrangement can be desirable in applications such as sanding where it is desirable to apply a force against the target surface to better facilitate material removal.

Figure 10:
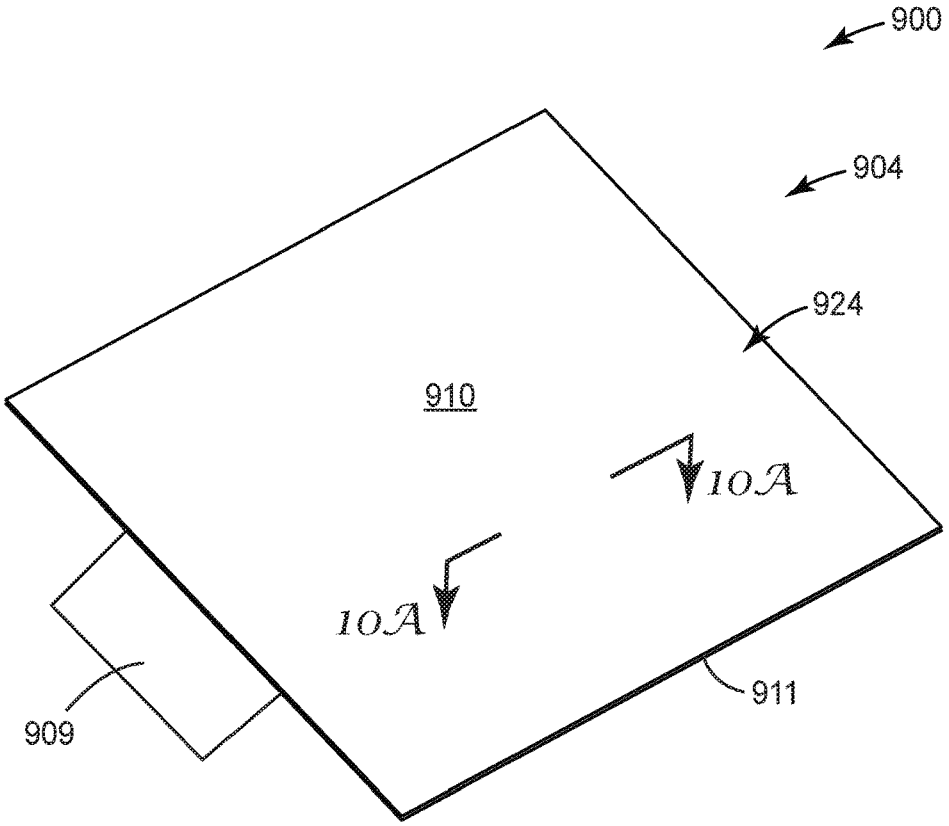
FIG. 10 is a perspective view of a layer of the first portion of the apparatus having an abrasive layer disposed on and secured to a surface thereof according to one embodiment of the present disclosure.

FIG. 10 shows perspective view of a layer 924 of a first portion 904 of an apparatus 900 having an abrasive layer 910 (FIG. 10A) disposed on and secured to a backing 911 thereof. In the embodiment of FIG. 10, the layer 924 and the first portion 904 can utilize a rigidifying material 918 that allows for flexibility in three-dimensions. However, in other embodiments, the rigidifying material 918 can be patterned in a manner as previously discussed in reference to the pattern of FIGS. 5 and 5A to allow the layer 924 and the first portion 904 to deform only orthogonal to a single axis, and therefore, remain rigid (relatively non-flexible) in at least one of the three-dimensions.

FIG. 10 shows an embodiment where a device 909 is coupled to the first portion 904. The device 909 can be operably configured to power a movement of the first portion 904. For example, the device 909 can be configured to vibrate at least the abrasive layer 910 against a target surface.

Figure 10A:
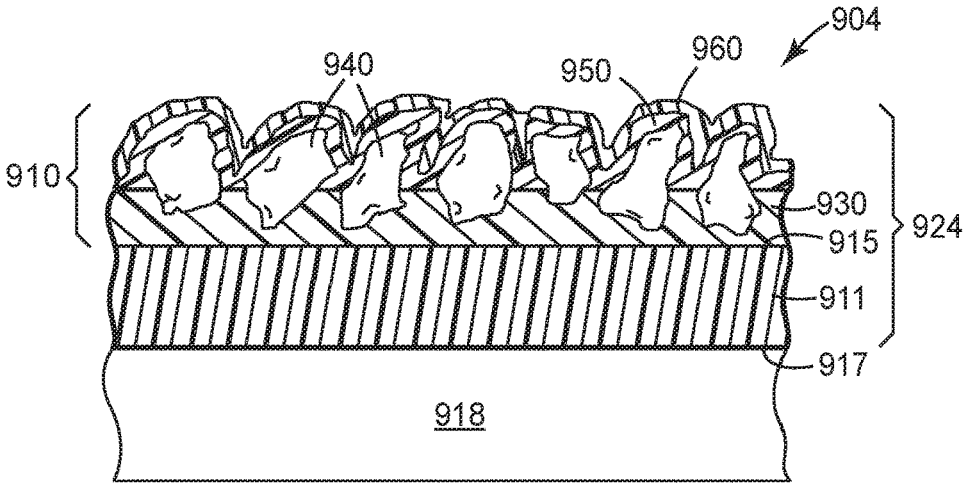
FIG. 10A is an enlarged cross-section of the layer, the abrasive layer, and additional features of the embodiment of FIG. 10.

FIG. 10A shows an enlarged cross-section of the abrasive layer 910 and additional articles. The first portion 904 can include unitary backing 911 having first and second opposed major surfaces 915, 917.

The backing 911 can be of polyurethane according to one embodiment. The abrasive layer 910 can be disposed on and secured to the first major surface 915 of the backing 911. According to the illustrated embodiment of FIG. 10A, the abrasive layer 910 can comprise make layer 930, abrasive particles 940, and size layer 950, which is disposed on make layer 930 and abrasive particles 940. Optional supersize layer 960 is disposed on size layer 950. The backing 911 can be attached to the outer envelope of the rigidifying material 918, or the backing 911 can comprise the outer envelope of the rigidifying material 918, or additional attachment layers (not shown) such as hook and loop, adhesive, or others may be used to hold the backing 911 of the outer layer 924 to the rigidifying material 912.

The backing 911 may be unitary; that is, it may consist of a single layer, although in certain embodiments it may be a composite backing, if desired. Typically, the backing 911 is at least substantially homogeneous, although this is not a requirement. The backing 911 may be perforated; however, if perforated, the average thickness is not determined using areas of the perforations where the thickness would, of course, be zero as no backing 911 is present there. The backing 911 is impermeable to liquid water and substantially free of void space, although minor amounts of porosity may be acceptable. For example, the backing 911 may have less than 10 percent, less than 2 percent, less than 1 percent, or even less than 0.01 percent of intrinsic voids (i.e., voids that are not deliberately added, but are an intrinsic property of the material making up the backing 911), based on the total volume of the backing 911. The backing 911 may comprise one or more polyurethanes. The polyurethane comprises, or at least consists essentially of, at least one thermoplastic polyurethane (TPU). The term "consisting essentially of as used in this context means that additive compounds (e.g., fragrances, colorants, antioxidants, UV light stabilizers, and/or fillers) may be present in the backing 911 as long as tensile strength and ultimate elongation remains substantially unaffected by their presence. For example, the additives may have less than a 5 percent, less than 1 percent, effect on tensile strength and ultimate elongation.

In some embodiments, the backing 911 may comprise a single thermoplastic polyurethane or a combination of thermoplastic polyurethanes. One class of polyurethanes is aromatic polyether-based polyurethanes, thermoplastic polyether-based polyurethanes. In some embodiments, the thermoplastic polyether-bases polyurethanes are derived from 4,4'-methylenedicyclohexyl diisocyanate (MDI), a polyether polyol, and butanediol.

Thermoplastic polyurethanes are well known and can be made according to many known techniques, or they may be obtained for commercial suppliers. For example, Lubrizol Corp., Cleveland, Ohio, is one commercial supplier of various thermoplastic polyurethanes such as, for example: polyester-based aromatic TPUs available under the trade designation "ESTANE GP TPU (B series)" (e.g., grades 52 DB, 55 DB, 60 DB, 72 DB, 80 AB, 85 AB, and 95 AB); and polyester and polyether based TPU s available under the trade designation "ESTANE 58000 TPU series" (e.g., grades 58070, 58091, 58123, 58130, 58133, 58134, 58137, 58142, 58144, 58201, 58202, 58206, 58211, 58212, 58213, 58215, 58219, 58226, 58237, 58238, 58244, 58245, 58246, 58248, 58252, 58271, 58277, 58280, 58284, 58300, 58309, 58311, 58315, 58325, 58370, 58437, 58610, 58630, 58810, 58863, 58881, and 58887).

Abrasive particles suitable for use in abrasive layer 910 utilized in practice of the present disclosure include any abrasive particles known in the abrasive art. Exemplary useful abrasive particles include fused aluminum oxide based materials such as aluminum oxide, ceramic aluminum oxide (which may include one or more metal oxide modifiers and/or seeding or nucleating agents), and heat-treated aluminum oxide, silicon carbide, co-fused alumina-zirconia, diamond, ceria, titanium diboride, cubic boron nitride, boron carbide, garnet, flint, emery, sol-gel derived abrasive particles, and blends thereof. Desirably, the abrasive particles comprise fused aluminum oxide, heat-treated aluminum oxide, ceramic aluminum oxide, silicon carbide, alumina zirconia, garnet, diamond, cubic boron nitride, sol-gel derived abrasive particles, or mixtures thereof. Examples of sol-gel abrasive particles include those described U.S. Pat. No. 4,314,827 (Leitheiser et al.); U.S. Pat. No. 4,518,397 (Leitheiser et al.); U.S. Pat. No. 4,623,364 (Cottringer et al.); U.S. Pat. No. 4,744,802 (Schwabel); U.S. Pat. No. 4,770,671 (Monroe et al.); U.S. Pat. No. 4,881,951 (Wood et al.); U.S. Pat. No. 5,011,508 (Wald et al.); U.S. Pat. No. 5,090,968 (Pellow); U.S. Pat. No. 5,139,978 (Wood); U.S. Pat. No. 5,201,916 (Berg et al.); U.S. Pat. No. 5,227,104 (Bauer); U.S. Pat. No. 5,366,523 (Rowenhorst et al.); U.S. Pat. No. 5,429,647 (Laramie); U.S. Pat. No. 5,498,269 (Larmie); and U.S. Pat. No. 5,551,963 (Larmie).

Further details regarding the manufacture and configuration of the abrasive layer 910, backing 911 and other articles illustrated in FIG. 10A are described in co-pending International Patent Application Publication WO2015167910A1, filed Apr. 23, 2015, which claims priority to U.S. Provisional Patent Applications 61/987,155 and 62/078,013, all of which are incorporated herein by reference in their entirety.

Figure 11:
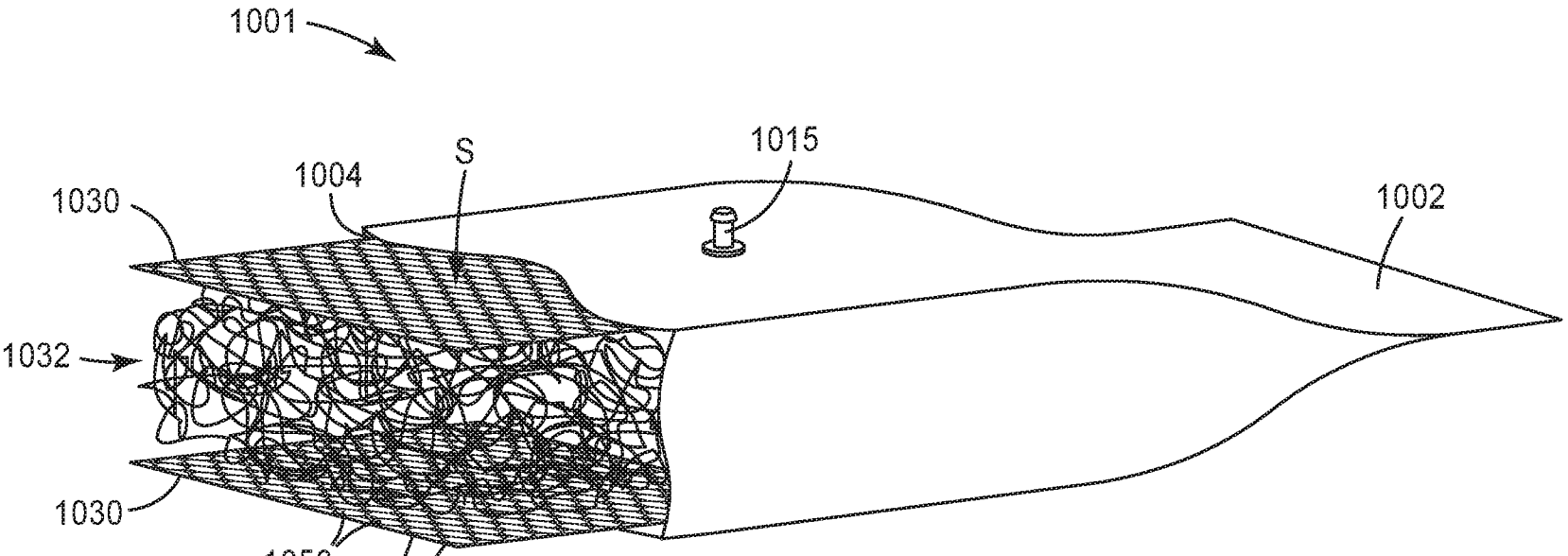
FIG. 11 is a cutaway perspective view of the first portion according to one embodiment of the present disclosure, employing both fibers and sheets according to one embodiment of the present disclosure.

FIG. 11 illustrates a shape-formable first portion 1001 according to another embodiment of the present disclosure. The first portion 1001 combines sheets 1030 (e.g., sheets 130 of FIGS. 2A to 2C) with fibers 1032 (e.g., fibers 132 of FIGS. 2D and 2E) within an envelope 1002.

As shown in FIG. 11, the first portion 1001 can include the envelope (or shell, or pouch) 1002 that defines an internal chamber 1004; at least two adjacent sheets 1030 positioned in the chamber 1004, and fibers 1032 positioned in the chamber 1004 between the sheets 1030. The first portion 1001 can further include a port, or opening, 1015 in the envelope 1002 that is positioned to fluidly couple the chamber 1004 with ambience, and through which the chamber 1004 can be evacuated, e.g., by being coupled to a vacuum source (not shown). The port 1015 in this configuration or other embodiments may be positioned at various locations on the envelope based upon the form factor and operational efficiency or conditions of a vacuum source (not shown).

For clarity purposes, the top and bottom sides of the envelope 1002 are illustrated in FIG. 11 as being substantially spaced apart (i.e., with a sidewall joining them). However, in some embodiments, in reality, the first portion 1001 can appear much flatter, having a sheet-like or plate-like configuration.

As has been previously discussed, the first portion 1001 can be configured to be formed into, and held in, a desired shape. That is, the first portion 1001 can have a first state in which the first portion 1001 is formable (as described previously), such that the first portion 1000 can be formed to take on a desired shape. The first portion 1001 can also have a second state in which the first portion 1001 has the desired shape and is substantially rigid, or at least substantially more rigid than in the first state, and in which the desired shape is held or locked (i.e., substantially non-formable).

As a result, the first portion 1001 is formable, deformable, conformable, and/or manipulatable in the first state, and substantially not formable, deformable, conformable, and/or manipulatable in the second state. Terms such as formable, deformable, conformable, and/or manipulatable can be used when describing the ability of the first portion 1001 (and in particular a layer thereof) to take any desired shape in the first state, the opposite being true when the first portion 1001 (and a layer thereof) is in the second state.

For simplicity, the first state can be described as a state in which the first portion 1001 is formable or in which the shape (e.g., the two or three-dimensional shape) of the first portion 1001 is changeable or unlocked; and the second state can be described as a state in which the first portion 1001 is "rigid," or in which the shape (e.g., the two or three-dimensional shape) of the first portion 1001 is fixed or locked.

The first portion 1001 can be changed into the second state by using the vacuum source (not shown) to evacuate the chamber 1004 (i.e., to remove gas from the chamber 1004). After the first portion 1001 has been formed into its desired shape and changed from the first state to the second state, the port 1015 (or a connector, etc.) can be sealed and/or disconnected from the vacuum source (not shown), and the first portion 1001 can remain in the second state in the desired shape.

FIG. 11 illustrates the first portion 1001 can include elements having a generally sheet-like or plate-like, or has a sheet-like or plate-like configuration. As such these elements are referred to as sheets 1030 herein. For clarity purposes, the sheets 1030 are illustrated as being substantially spaced apart from one another. However, it can be understood that this illustration is used merely to more clearly show how the sheets 1030 can stack with respect to one another and the fibers 1032 can be positioned in the chamber 1004 relative to the sheets 1030. In reality, the first portion 1001 can appear much flatter and can have various arrangements of sheets 1030 with fibers 1032. According to other embodiments, the sheets 1030 and/or fibers 1032 can be substituted for another material such as a bulk media as desired.

Additional interposed arrangements of sheets 1030 (e.g., six sheets) and fibers 1032 (e.g., five layers of fibers) can be added in other embodiments. The fiber 1032 need not be located in each and every space created between the adjacent sheets 1030. By way of example only, four sheets 1030 could be utilized to define three spaces therebetween, and three fiber 1032 layers (or three portions of fiber 1032) can be located in these spaces defined between adjacent sheets 1030.

In some embodiments, the sheets 1030 can be solid, and in some embodiments, as shown subsequently and previously in reference to FIGS. 5 and 5A, the sheets 1030 can include (i.e., at least a portion of the sheet 1030 can be formed of or include) a pattern. In some embodiments, as described in greater detail below, and as illustrated in FIGS. 5 and 5A, the sheets 1030 can each be patterned to include solid regions 1052 and open regions 1054 (i.e., openings that pass through the thickness of the sheet 1030). That is, in such embodiments, the sheet 1030 can be patterned, e.g., to form indentations or crease lines, but the patterns are not formed all the way through the thickness of the sheet so as to form open regions or cutouts. Such patterned but not through-cut sheets will simply be referred to as "patterned sheets" or "patterned support sheets." As a result, in embodiments employing sheets, the sheets can include solid sheets, patterned sheets, and/or strips of thin sheets, which are described in greater detail below. A combination of solid, patterned and strips of thin sheets can be employed in one apparatus of the present disclosure, e.g., in an alternating or random arrangement.

As previously discussed in reference to FIGS. 5 and 5A, in some embodiments, the sheets 1030 can be patterned, e.g., to improve the flexibility (bendability) and/or the extensibility of the sheet, without being formed into solid regions and open regions. Other embodiments, utilize sheets 1030 that can be patterned to have a flexibility along one or two axes but to have a desired stiffness along a third axis.

Solid and patterned sheets of the present disclosure can be single or multi-layer (e.g., laminated) constructions and can be formed of a variety of materials, including, but not limited to, paper; a metal, which can be annealed for enhanced softness and malleability (e.g., steel, aluminum); laminated metal layers or foils (e.g., of the same or different metals); a polymeric material (e.g., polyurethanes, polyolefins), a composite material (e.g., carbon fiber); elastomers (e.g., silicones, styrene-butadiene-styrene); other suitable materials; and combinations thereof.

Patterned sheets of the present disclosure can be formed by a variety of processes, including, but not limited to, embossing, engraving, any of the processes listed below for making sheets of the present disclosure, other suitable processes, or a combination thereof.

In some embodiments, the envelope 1002 can be formed of an elastomeric material that is highly extensible and conformable, such that the overall extensibility or conformability of the first portion 1001 is not limited by the envelope 1002. Said another way, the extensibility and the conformability of the envelope 1002 is at least that of one sheet and/or the fiber 1032, one sheet 1030 (if employed), or at least that of a plurality of sheets 1030 (if employed). More specifically, in some embodiments, the envelope 1002 can have a tensile modulus (e.g., Young's modulus or a bending modulus that is less than the fiber 1032, one sheet 1030 (if employed), less than the plurality of sheets 1030 (if employed).

Examples of elastomeric materials can include silicones, polydimethylsiloxane (PDMS), liquid silicone rubber, poly (styrene-butadiene-styrene), other suitable thermoplastic elastomers, and combinations thereof.

Examples of thermoplastic materials can include one or more of polyolefins (e.g., polyethylene (high density polyethylene (HDPE), medium density polyethylene (MDPE), low density polyethylene (LDPE), linear low density polyethylene (LLDPE)), metallocene polyethylene, and the like, and combinations thereof), polypropylene (e.g., atactic and syndiotactic polypropylene)), polyamides (e.g. nylon), polyurethane, polyacetal (such as Delrin), polyacrylates, and polyesters (such as polyethylene terephthalate (PET), polyethylene terephthalate glycol (PETG), and aliphatic polyesters such as polylactic acid), fluoroplastics (such as THV from 3M company, St. Paul, Minn.), and combinations thereof.

Examples of thermoset materials can include one or more of polyurethanes, silicones, epoxies, melamine, phenol-formaldehyde resin, and combinations thereof.

Examples of biodegradable polymers can include one or more of polylactic acid (PLA), polyglycolic acid (PGA), poly(caprolactone), copolymers of lactide and glycolide, poly(ethylene succinate), polyhydroxybutyrate, and combinations thereof.

In embodiments employing a polymeric envelope 1002, the envelope 1002 can be formed by a variety of methods, including relatively facile manufacturing methods, such as extrusion, molding, or combinations thereof.

In some embodiments (such as for molding or smoothing applications), one or more surfaces of the envelope 1002 (e.g., an outer surface thereof), or a portion thereof, can include a low friction surface, which can be achieved by the material composition and/or texture of the respective surface or by treating the surface (e.g., with a coating, or by coupling a low-friction layer to a desired portion of the envelope 1002, etc.).

In some embodiments, the first portion 1001 can be in the first state when the internal pressure within the chamber 1004 is equal to ambient pressure (e.g., about 101 kPa at sea level), or is within +/−5% of ambient pressure. However, the chamber 1004 can be at least partially evacuated (e.g., by coupling the port 1015 to the vacuum source (not shown) (see FIG. 11) and evacuating the chamber 1004, i.e., removing gas from the chamber 1004) to change the first portion 1001 to the second state, in which the internal pressure within the chamber 1004 is reduced below ambient pressure (e.g., greater than 5% below ambient pressure).

The vacuum source (not shown) can be understood to be a variety of suitable vacuum sources can be coupled to the first portion 1001. For example, the vacuum source (not shown) can include, but is not limited to, one or more of a mechanical pump, a manual pump such as a syringe-plunger combination, other suitable vacuum sources that can reduce the pressure in the chamber 1004, or a combination thereof.

The vacuum source (not shown) can be coupled to the port 1015 of the first portion 1001 by a connector (not shown). In some embodiments, one or both of the connector and the vacuum source (not shown) can be considered to form a portion of the first portion 1001 (e.g., the envelope 1002 can be integrally formed with or include the connector); however, in some embodiments, the first portion 1001 can be considered to be coupled to one or both of the connector and the vacuum source (not shown).

In some embodiments, the fiber 1032 can be in the form of a sheet or can be sheet-like, which can enable the first portion 1001 to remain sheet-like as well. In some embodiments, the fiber 1032 can be formed of woven or non-woven materials, such as nonwovens available under the trade designation 3M™ SCOTCHBRITE™ from 3M Company, St. Paul, Minn. In some embodiments, the fiber 1032 can be in the form of a bundle of fibers (e.g., loose fibers), and such fibers can include many shorter fibers, fewer but longer fibers, other suitable bundled fiber configurations, or a combination thereof.

The term "fiber" or phrase "fibrous material" refers to a material comprised of fibers, where the individual fibers, or some groups of fibers, have the ability to move relative to other fibers or fiber groups. That is, in fibrous materials of the present disclosure, the fibers (or portions thereof, e.g., in embodiments in which the fibrous material is formed of one continuous fiber) are movable relative to one another within the fibrous material (i.e., without damaging the fibers or otherwise changing the nature of the material). Such relative movement of fibers (or portions thereof) can be due to physical space between the fibers, such as in a 3M™ SCOTCHBRITE™ nonwoven (3M Company), or some collection of fibers that are bonded to each other but with some spacing between the fibers. The physical space allows the fibers to bend and straighten or align along an axis even if the fibers are attached to other fibers at one or more points along their length. In some embodiments, fibers may not be bonded or fixed in any way to other fibers (e.g., as with a mat of steel wool or fiberglass), allowing the fibers the ability to move relative to other fibers. In both cases, the fibers are only restricted from movement by friction between the fibers, which is generally low at ambient pressure, but can be greatly increased by reducing the pressure in the chamber 1004 below ambient pressure, causing the fibers to "lock" together. Fibrous materials of the present disclosure do not include materials such as paper or wood that are made of fibers that cannot move relative to each other without damaging the fibers or changing the nature of the material. Paper or wood materials could be used as sheet materials in other embodiments of the present disclosure.

The fiber 1032 can be formed of a variety of processes generally known to those of skill in the art of fiber making, including, but not limited to, melt-blown processes, spinning processes, extrusion processes, any of the fiber processes described below, other suitable processes, or a combination thereof.

The fiber 1032 can be formed of a variety of materials that are suitable for being processed into fibers, including, but not limited to, metals (e.g., steel (e.g., steel wool) aluminum, other suitable metals, or combinations thereof); polymers (e.g., polypropylene (PP), polyethylene terephthalate (PET), polylactic acid (PLA), polyglycolic acid (PGA), other suitable polymeric materials, or combinations thereof); textiles; ceramics (e.g., ceramic fibers, available under the trade designation 3M™ NEXTEL™ Ceramic Textiles, from 3M Company, St. Paul, Minn.); composite materials (e.g., fiberglass); other suitable materials; or combinations thereof.

In such embodiments, the fiber 1032 need not all be the same type (e.g., nonwoven vs. bundle of fibers, etc.), and need not all be made of the same material. Rather, in some embodiments, the first portion 1001 can include fiber 1032 of more than one type and/or material makeup. The fiber 1032 can be formable when the first portion 1001 is in the first state, e.g., as a result of the fibers being movable past one another and/or relative to sheets 1030 (if employed). However, when the pressure in the chamber 1004 is reduced below ambient pressure and air is removed (or eliminated) from the fibers 1032, the fibers 1032 can jam against each other, behaving more like a block of the material making up the fibers. As a result, if the fibers have a high stiffness (e.g., a high tensile modulus), then the reduced pressure fiber 1032, or jammed block of fiber 1032, will be very stiff, and the first portion 1001 will be very stiff in its second state. The material makeup of the fibers, arrangement of the fibers, and the type of fibers can all be varied to achieve an apparatus having the desired formability in the first state and the desired rigidity or stiffness in the second state.

The fibers can be randomly arranged within the chamber 1004 of the first portion 1001, or they may be arranged in multiple layers of nominally parallel fibers (possibly with the fibers of one layer nominally perpendicular to the next), or they may be woven out of ribbon or looser rove bands of fiber. One or more layers of complex, textile-like patterns of weaving could also be used to arrange the fibers. If a continuous length of fiber extends across the first portion 1001 in any one axis, then the extensibility and some conformability of the first portion 1001 may be lost along that axis. However, a higher bending of the first portion 1001 may be achieved when vacuum is applied. The axis of the higher stiffness may be aligned with a preferred direction of the apparatus, similar to the preferred axis described in FIG. 5. If the lengths of fiber are overlapping lengths of fiber that extend across the first portion 1001, then greater extensibility (and thereby conformability) can be enabled.

In some embodiments, fibers can be defined by an aspect ratio, which can be defined as the ratio of fiber length to a representative transverse dimension depending on the cross-sectional shape of the fiber (e.g., diameter)). In some embodiments, the fibers can have an aspect ratio of at least 10; in some embodiments, at least 20; in some embodiments, at least 25; in some embodiments, at least 30; in some embodiments, at least 50; in some embodiments, at least 75; in some embodiments, at least 100; in some embodiments, at least 250; and in some embodiments, at least 300. In some embodiments, the fibers forming the fibrous material can have aspect ratio of no greater than 1000; in some embodiments, no greater than 750; and in some embodiments, no greater than 500.

In some embodiments, fibers can be classified into two classes: (i) short fibers, also known as discontinuous fibers, having an aspect ratio in the range of about 20 to about 60; and (ii) long fibers, also known as continuous fibers, having an aspect ratio ranging from about 200 to about 500. In some embodiments, the fiber 1032 can be formed of short fibers, long fibers, other lengths of fibers, or combinations thereof.

In some embodiments, satisfactory fibers for use in the fiber 1032 can have (i) a length of between about 20 and about 110 mm in length, and in some embodiments, between about 40 and about 65 mm, and (ii) a fineness or linear density ranging from about 1.5 to about 500 denier, and in some embodiments, from about 15 to about 110 denier. In some embodiments, fibers of mixed denier can be used in the manufacture of the fiber in order to obtain a desired surface texture or finish. The use of larger fibers is also contemplated, and those skilled in the art will understand that the invention is not limited by the nature of the fibers employed or by their respective lengths, linear densities and the like.

The cross-sectional shape of fibers can also be controlled and adjusted by the use of specific spinneretes, as described in "Applications of non-circular cross-section chemical fibers" by Xiaosong Liu, et. Al. in Chemical Fibers International December 2011; 61(4):210-212. The fibers forming the fibrous material can have a variety of cross-sectional shapes, including, but not limited to, round, square, triangular, oval, hollow (e.g., ring-shaped), star, polygon, cross, "X", "T", more complex and/or irregular cross-sectional shapes (e.g., tri-lobal, deep-grooved), other suitable cross-sectional shapes; and combinations thereof. In addition, the cross-sectional shape and/or dimension of the fibers need not be constant along its length.

The fiber 1032 can be formed of a variety of suitable fibers, including natural fibers, synthetic fibers, and combinations thereof. Suitable synthetic fibers can include those made of polyester (e.g., polyethylene terephthalate), nylon (e.g., hexamethylene adipamide, polycaprolactam), polypropylene, acrylic (formed from a polymer of acrylonitrile), rayon, cellulose acetate, polyvinylidene chloride-vinyl chloride copolymers, vinyl chloride-acrylonitrile copolymers, other suitable synthetic fibers, and combinations thereof. Suitable natural fibers can include those of cotton, wool, jute, hemp, other suitable natural fibers, and combinations thereof.

The fiber 1032 can be virgin fibers or waste fibers reclaimed from garment cuttings, carpet manufacturing, fiber manufacturing, or textile processing, for example. The fiber material can be a homogenous fiber or a composite fiber. Composite fibers can include multicomponent fibers, such as bicomponent fibers (e.g., co-spun sheath-core fibers, side-by-side fibers, etc.). It is also within the scope of the present disclosure to provide a fiber comprising different fibers in different portions of the web (e.g., a first web portion, a second web portion and a middle web portion).

In some embodiments, the fiber 1032 can be made of, but is not limited to, an air-laid, carded, stitch-bonded, spunbonded, wet laid, or melt blown construction. In some embodiments, fiber 1032 can include an open, lofty, three-dimensional air-laid nonwoven substrate, as described in U.S. Pat. No. 2,958,593 to Hoover et al., the disclosure of which is herein incorporated by reference. Such a nonwoven is formed by randomly disposed staple fibers. One example of such a nonwoven is available under the trade designation "SCOTCH-BRITE" from 3M Company, St. Paul, Minn.

In some embodiments, the fiber 1032 can have a weight per unit area of at least 20 $g/m^2$; in some embodiments, between 20 and 1000 $g/m^2$, and in some embodiments, between 300 and 600 $g/m^2$. Such fiber weights can provide a web, before needling or impregnation, having a thickness from about 1 to about 200 mm, in some embodiments, from about 6 to about 75 mm, and in some embodiments, from about 10 to about 50 mm.

In some embodiments, the fiber 1032 be reinforced, for example, by the application of a prebond resin to bond the fibers at their mutual contact points to form a three-dimensionally integrated structure. The prebond resin may be made of a thermosetting water-based phenolic resin. Polyurethane resins may also be employed. Other useful prebond resins may include those comprising polyureas, styrene-butadiene rubbers, nitrile rubbers, and polyisoprene. Additional crosslinker, fillers, and catalysts may also be added to the prebond resin. Those skilled in the art will appreciate that the selection and amount of resin actually applied can depend on any of a variety of factors including, for example, the fiber weight in the fiber 1032, the fiber density, the fiber type, and the contemplated end use for the first portion 1001.

The number of sheets 1030 can be selected to be a number that provides sufficient formability of the first portion 1001 in the first state, while also providing sufficient rigidity in the second state for a given application. In some embodiments, the number of sheets 1001 employed can depend on the material makeup and the thickness of each sheet 1001.

The sheets 1030 of the present disclosure can be formed of a variety of materials, depending on the desired application or use of the first portion 1001, and can include single or multi-layer constructions. Examples of suitable sheet materials include, but are not limited to, paper; a metal, which can be annealed for enhanced softness and malleability (e.g., steel, aluminum); a polymeric material (e.g., ABS, or Delrin), a composite material (e.g., carbon fiber); other similar suitable materials, and combinations thereof.

In some embodiments, sheets 1030 can all be formed of the same material; however, the sheets 1030 employed in one first portion 1001 need not all be formed of the same materials. In some embodiments, some of the sheets 1030 are formed of the same materials, while other(s) of the sheets 1030 are formed of one or more different materials. In addition, as mentioned above, the sheets 1030 in one first portion 1001 can include a variety of solid, patterned designs. In some embodiments, the sheets 1030 can be arranged (e.g., stacked) in the chamber 1004 according to material makeup and/or type (i.e., solid, patterned, and/or surface textured), such as in an alternating configuration. For example, in some embodiments, a sheet can be formed of a first material can be positioned adjacent a sheet of a second material, which can be positioned adjacent a sheet of the first material, and so on. However, in some embodiments, the sheets 1030 of different materials can be arranged in other configurations, or even randomly, in the chamber 1004.

In some embodiments, the sheets 1030 can all have the same thickness (i.e., in a Z direction that is orthogonal to the major surface of the sheet 1030); however, in some embodiments, the sheets 1030 employed in one first portion 1001 need not all have the same thicknesses. In some embodiments, some of the sheets 1030 can have the same thickness, while other(s) of the 1030 can have one or more different thicknesses. In some embodiments, the sheets 1030 can be arranged (e.g., stacked) in the chamber 1004 according to thickness, for example, in order of increasing thickness, decreasing thickness, alternating thickness, another suitable configuration, or a combination thereof. However, in some embodiments, the sheet 1030 having different thicknesses can be arranged randomly in the chamber 1004. In addition, in some embodiments, one or more sheets 1030 can have a varying thickness, such that the thickness is not constant throughout the sheet 1030.

In some embodiments, the patterned sheets 1030 of the present disclosure can be formed by a variety of methods, including but not limited to, extrusion, molding, laser cutting, water jetting, machining, stereolithography or other 3D printing, laser ablation, photolithography, chemical etching, rotary die cutting, stamping, punching, other suitable negative or positive processing techniques, or combinations thereof.

As discussed previously, when the first portion 1001 is in the first state, the sheets 1030 can be formable, and can slide relative to one another, i.e., such that the major surfaces of adjacent sheets 1030 slide past one another (e.g., in X and Y directions), and can also move relative to one another in a Z direction that is orthogonal to any point along the major surfaces of the sheets 1030. However, when the first portion 1001 is in the second state (i.e., when the chamber 1004 is evacuated), the sheets 1030 can be substantially immovable or "locked" relative to one another, in the surface (e.g., X and Y) and Z directions, such that the first portion 1001 is "substantially/essentially immovable" or "substantially/essentially locked."

A "substantially/essentially immovable" or "substantially/essentially locked" first portion 1001 can also be referred to as "substantially rigid," "substantially more rigid than in the first state," or "substantially less formable than in the first state," "relatively rigid" simply "rigid" and, in some embodiments, can be characterized by comparing a material property (e.g., a measure of stiffness, such as tensile modulus) of the first portion 1001 when the first portion 1001 is in the second (locked) state with the same material property of the first portion 1001 when the first portion 1001 is in the first (unlocked) state, as described in greater detail below.

As further shown in FIG. 11, at least a portion of each sheet 1030 can be patterned or segmented into solid regions 1050 and open regions 1052 (i.e., gaps or free spaces between solid regions 1050), such that at least some of the solid regions 1050 are movable with respect to one another within a major surface S of the sheet 1030.

In embodiments employing sheets 1030 and fibers 1032, portions of the fibers 1032 can aid in jamming or locking the first portion 1001 in the second state, e.g., by at least partially penetrating the open regions 1052 of the sheets 1030. In addition, or alternatively, the solid regions 1050 of the sheets 1030 can jam together with the fibers 1032; and/or any high friction surfaces of the sheets 1030 can jam with the fibers 1032.

Figure 12:
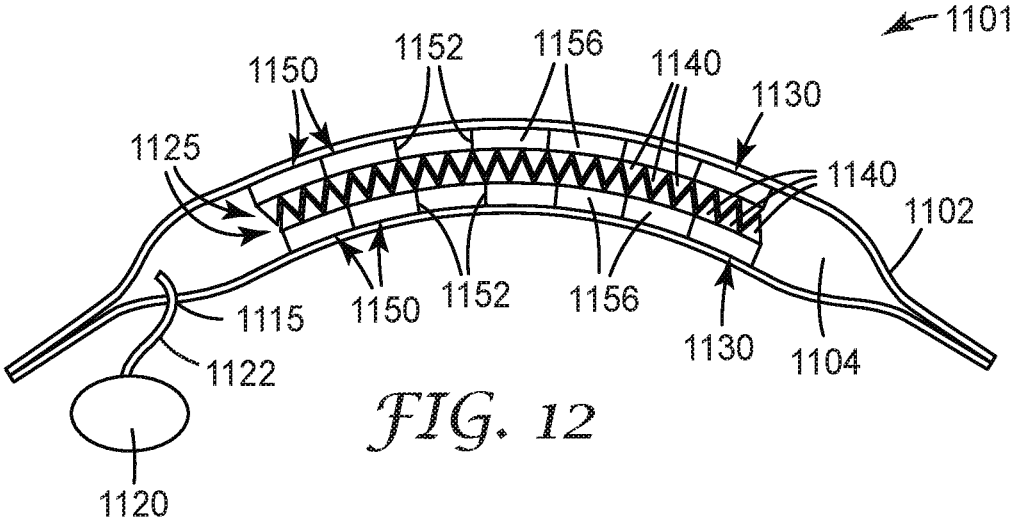
FIG. 12 is a schematic cross-sectional view of the first portion according to another embodiment of the present disclosure, employing a surface roughness on the sheets according to one embodiment of the present disclosure.

FIG. 12 shows another embodiment of a first portion 1101 utilizing many of the elements and features previously discussed in reference to FIGS. 2A-2E and 11, for example. Additionally, the embodiment of FIG. 12 illustrates one or more sheets 1130 (or indeed any of the sheets disclosed in this application) can be provided with a surface roughness, or micro-replicated structures, or some other features to facilitate interlocking of the sheets 1130 together when a chamber 1104 is in a lower pressure state as shown in FIG. 12.

The first portion 1101 includes an envelope 1102 that defines the chamber 1104, sheets 1130, a port 1115, a connector 1122, and a vacuum source 1120 that are each shown schematically merely for purposes of illustration. The construction and operation of these components have been discussed previously and will not be discussed in great detail. Solid regions 1150 and the open regions 1152 of the sheets 1130 have also been discussed previously and are shown schematically for illustration purposes.

It can be understood that the sheets 1130 can be patterned similar to any other sheet of the present disclosure and can additionally represent continuous sheets as well. As shown, the solid regions 1150 can include islands 1156 that can be connected to adjacent islands by bridges that extend through the open regions 1152.

As shown by way of example, a surface 1125 of each sheet 1130 includes a high friction surface, and particularly, includes a plurality of engagement features 1140. The top sheet 1130 can be referred to as a first sheet 1130 having a plurality of first engagement features 1140, and the bottom sheet 1130 can be referred to as a second sheet 1130 having a plurality of second engagement features 1140 configured to engage the plurality of first engagement features 1140. The surfaces 1125 are shown by way of example as including the high friction surface, i.e., the engagement features 1140, across the entire surface 1125; however, as described above, this need not be the case.

The engagement features 1140 are shown schematically as having triangular cross-sectional shapes, such that engagement features 1140 in one sheet 1130 can inter-engage with engagement features 1140 in the other sheet 1130. Specifically, the engagement features 1140 schematically represent engagement features 1140 that protrude in the Z direction toward an adjacent sheet 1130, such that when the sheets 1130 are brought into contact as illustrated in FIG. 12, the engagement features 1140 from one sheet 1130 will be moved into the openings or spaces between adjacent engagement features 1140 in the other sheet 1130.

The two sheets 1130 are shown in FIG. 12 by way of example only; however, it can be understood that one or more solid or patterned sheets could be employed in the first portion 1101 instead of, or in addition to, the two illustrated sheets 1130. Additionally, in some embodiments, one or both of the illustrated sheets 1130 can be solid or patterned sheets instead, and can still include the high friction surfaces on the surfaces 1125 that can be configured to engage a fiber (not shown) in addition to or in alternative to an adjacent and opposing sheet.

In some embodiments, high friction surfaces can be an inherent result of a manufacturing process. For example, paper can itself have a sufficiently high friction surface for two sheets 1130 made of paper to inter-engage under vacuum. In other embodiments, high friction surfaces can be formed by one or more of embossing, knurling, any suitable microreplication process, abrading, sand-blasting, molding, stamping, vapor deposition, other suitable means of forming a high friction surface, or combinations thereof. One example of a suitable structured high friction surface that can be employed on sheets of the present disclosure is a textured or structured material available under the trade designation, "3M™ Gripping Material" from 3M Company, St. Paul, Minn.

While two sheets 1130 are shown in FIG. 12 for simplicity, it can be understood that as many sheets 1130 as structurally possible or necessary can be employed in the first portion 1101. In some embodiments, only one sheet 1130 (solid or patterned) may be necessary to achieve the desired material properties of the first portion 1101 in its first state, while providing sufficient inter-engagement with fiber or another material. In some embodiments, the high friction surfaces can exist on both sides of a sheet, especially when more than two sheets are employed.

Figure 13A:
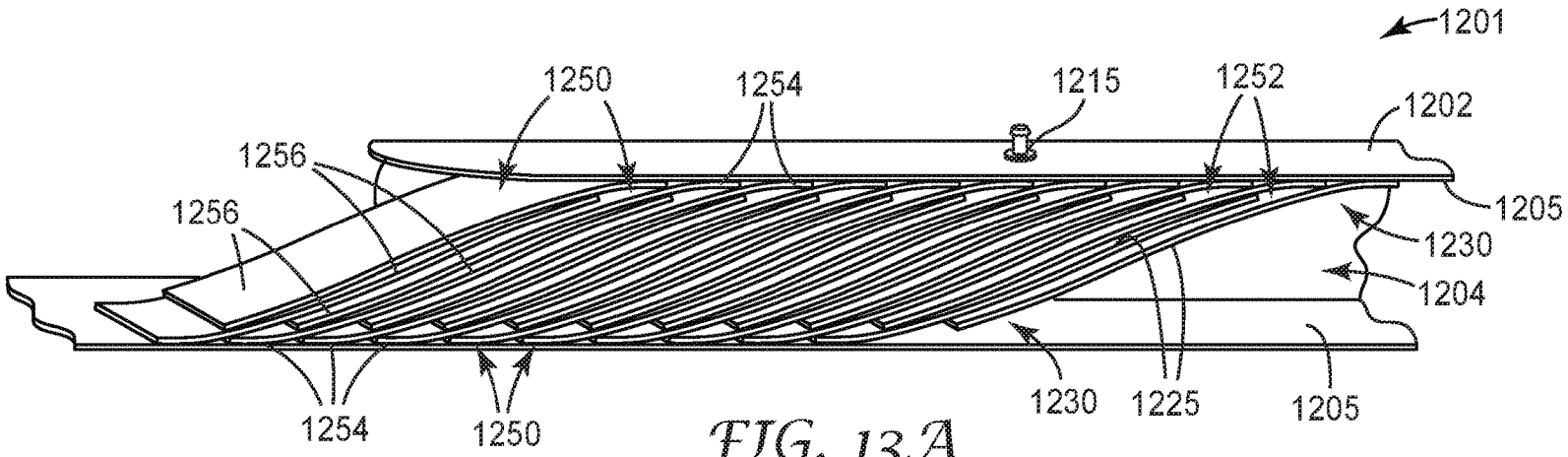
FIG. 13A is a partial perspective view of the first portion according to another embodiment of the present disclosure, employing sheets comprising overlapping discrete solid regions.
Figure 13B:
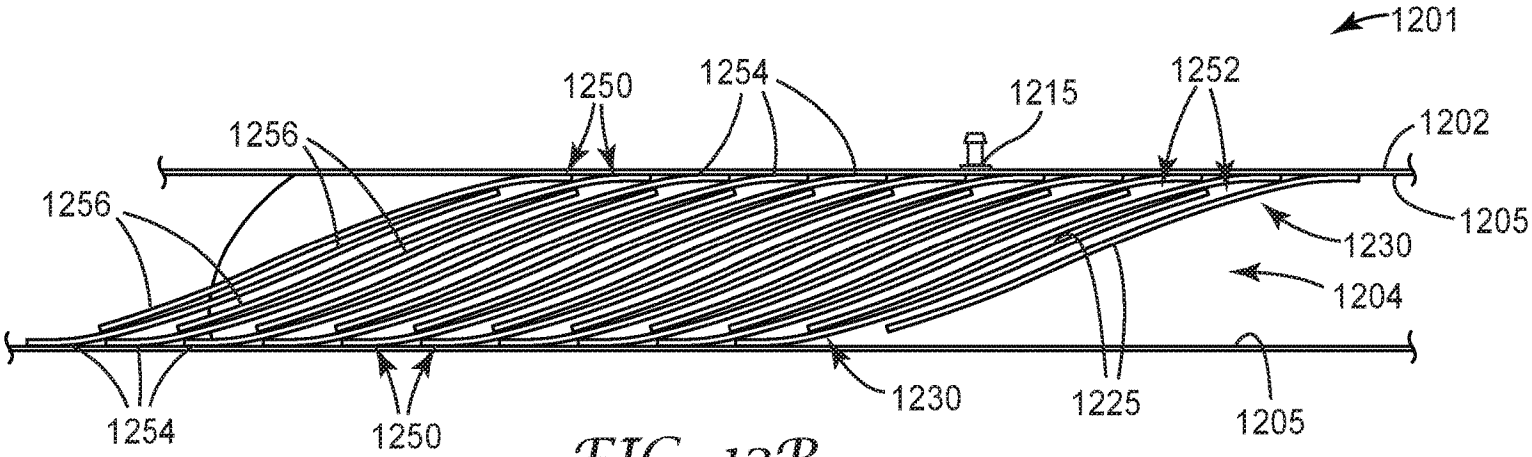
FIG. 13B is a schematic partial cross-sectional view of the first portion of FIG. 13A.

FIGS. 13A and 13B show an overlapping sheet design that can allow for a high level of conformability in a single axis but can have relatively more rigidity in at least a second axis. For example, in FIG. 13B the sheets can bend and conform within the plane of the cross sectional image, but any relative motion outside of that plane can be restricted by the geometry of the sheets and the envelope. The geometry of FIGS. 13A and 13B can be used in applications (for example in a sanding application) that utilize a force applied in and out of the plane of the FIGS. 13A and 13B.

FIGS. 13A and 13B illustrate a first portion 1201 according to another embodiment of the present disclosure that employ discontinuous sheets 1230. For simplicity and clarity, the first portion 1201 is illustrated without any fiber or other materials (e.g., bulk media), and the description below focuses on the features of the discontinuous sheets. However, fiber or another material of the present disclosure can also be employed.

FIGS. 13A and 13B illustrate close-up partial views of the first portion 1201. The first portion 1201 can be generally sheet-like or plate-like and can includes two or more discontinuous sheets 1230 (sometimes referred to herein as strips of sheets).

The first portion 1201 employs a construction discussed previously, and therefore, can include an envelope 1202 that defines a chamber 1204; the plurality of sheets 1230 comprising discrete solid regions (or "islands") 1250 and open regions 1252; and a port (or opening) 1215 positioned to fluidly couple the chamber 1204 with ambience, such that a vacuum source (not shown) can be coupled to the port 1215 for evacuating the chamber 1204.

The discontinuous sheets 1230 of FIGS. 13A and 13B can include discrete islands 1250 that each have a fixed end 1254 that is directly coupled to an inner surface 1205 of the envelope 1202 (or a substrate), and a free end 1256 that extends at least partially in a Z direction toward an adjacent sheet 1230. The free end 1256 may not be directly coupled to the envelope 1202 (or substrate). The fixed ends 1254 of the islands 1250 can be coupled to the envelope 1202 (and/or substrate, if employed) by any of the coupling methods described above.

In addition, the free ends 1256 of the islands 1250 of adjacent sheets 1230 are configured to overlap one another (similar to a deck of cards being shuffled). As a result, each sheet 1230 can still include islands 1250 that are movable relative to one another within a major surface of the sheet 1230, such that the first portion 1201 can be formable in a first state. However, the overlapping free ends 1256 of adjacent sheets 1230 can enhance the intimate contact between adjacent sheets 1230 and can result in stiffening of the first portion 1201, when the first portion is in the second state. By way of example, in some embodiments, fiber or another structure can be positioned between the free ends 1256 of the islands 1250 of adjacent sheets 1230, e.g., to enhance the friction and intimate contact between adjacent free ends 1256. In addition, or alternatively, fiber or another structure can be positioned at least between adjacent free ends 1256 of the islands 1250 of the same sheet 1230. Still, other ways of employing fiber, surface roughness or other structures in the first portion 1201 are possible and are within the spirit and scope of the present disclosure.

In some embodiments, the islands 1250 (or at least the free ends 1256 thereof) can include a surface 1225 oriented to face at least one adjacent sheet 1230, e.g., one or more free ends 1256 of islands 1250 in an adjacent sheet 1230. Such surfaces 1225 can include high friction surfaces, and can include any of the high friction surface features or alternatives described in embodiments above.

In addition, while the sheets 1230 are shown as being directly coupled to the envelope 1202, it can be understood that the sheets 1230 can instead be coupled to an additional substrate. In some embodiments, a discontinuous sheet can be employed between two larger sheets that may not include floating islands For clarity purposes only, the islands 1250 having overlapping free ends 1256 are illustrated in FIGS. 13A and 13B as angling away from the fixed ends 1254, and the top and bottom sides of the of the envelope 1202 are illustrated as being substantially spaced apart. However, it can be understood that this illustration is used merely to better and more clearly show how the free ends 1256 of the islands 1250 can overlap one another, and that, in reality, the first portion 1201 can still be sheet-like or plate-like, and the sheets 1230 can be considered to be oriented substantially parallel to one another.

While each sheet 1230 of FIGS. 13A and 13B is shown as including only one row of islands 1250, it can be understood that the sheets 1230 can include as few as one row of islands 1250, and as many as possible or necessary. The envelope 1202 can be sized to accommodate more than one row. In addition, the free ends 1256 of the islands 1250 are shown as overlapping along one axis or direction (e.g., an X direction). If more than one row is employed, each row can include islands 1250 with free ends 1256 that overlap in one axis, and the rows (and the axis of each row) can be oriented substantially parallel with respect to one another. However, in some embodiments employing more than one row of islands 1250, the islands 1250 can be sized and shaped, and coupled to the envelope 1202 (or substrate) accordingly, to allow for the islands to have free ends 1256 that overlap along more than one axis or direction (e.g., in an X direction and a Y direction).

The islands 1250 are shown as having a generally rectangular shape for example and illustration purposes only. However, it can be understood that the same configuration can be employed with any shape of islands 1250, e.g., including, but not limited to, circles, triangles, squares, trapezoids, any other polygonal shape, irregular or random shapes, other suitable shapes, or combinations thereof. The islands 1250 of one sheet 1230 need not all be the same but can be a variety of shapes, sizes and/or materials. It can be understood that sheets 1230 need not include the islands 1250 of the same shape, size or orientation.

FIG. 14 and FIGS. 15-19 (described below) can be representative of sheet patterns that can be employed within the first portion for various applications such as sanding, filling, smoothing, and molding, for example.

Figure 14:
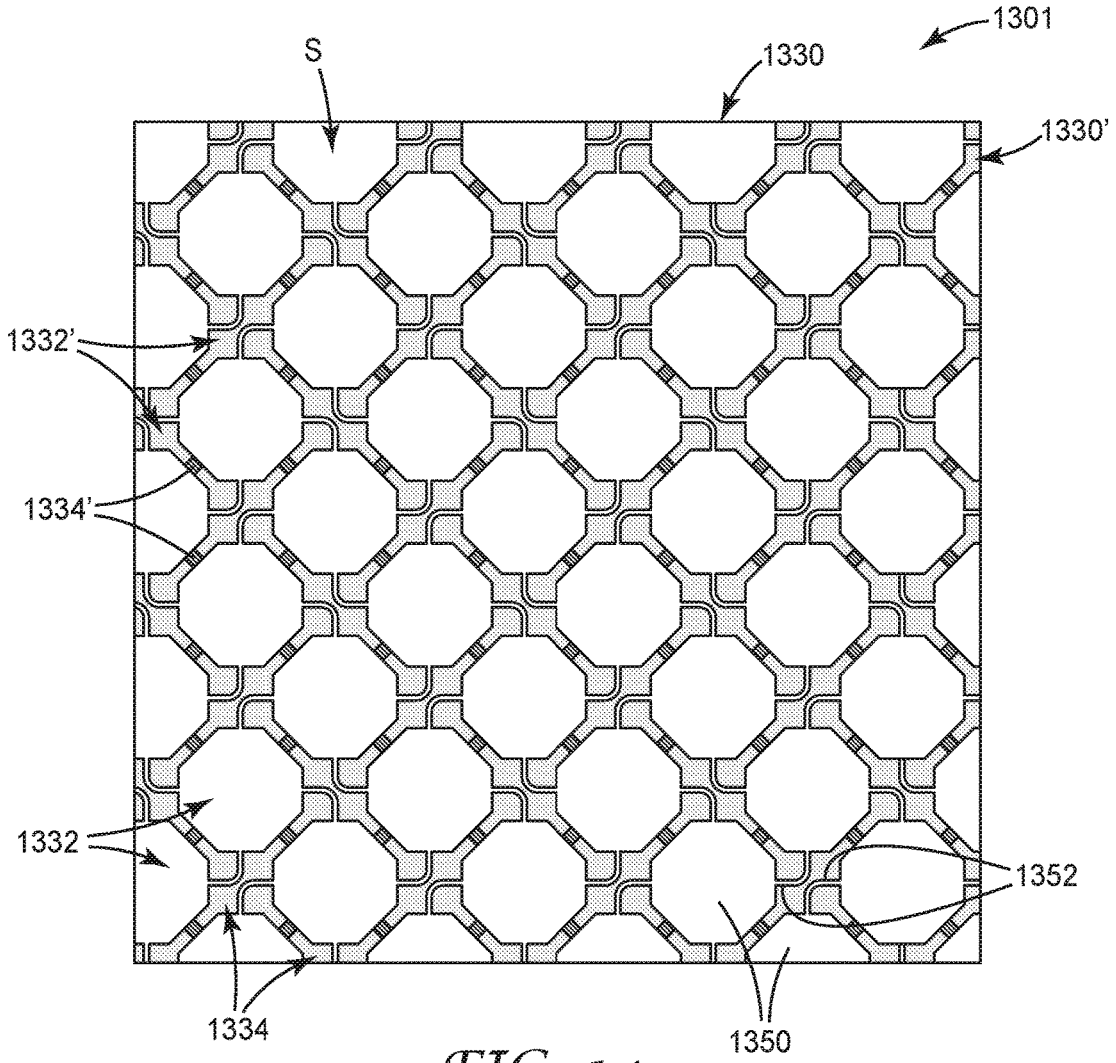
FIG. 14 is a top plan view of two sheets having a configuration of open regions and solid regions, the two sheets shown in a staggered configuration.

FIG. 14 shows an embodiment that utilizes two of a plurality of sheets 1330 employed in a first portion 1301. It can be understood that any of the features and elements of the sheets 1330 of FIG. 14 can be employed in apparatuses of the present disclosure including those using fiber, strips of sheets, bulk media or the like.

FIG. 14 shows the two identically-patterned sheets 1330, 1330' can be staggered with respect to one another, such that solid regions 1332 in a first sheet 1330 overlap open regions 1334' in the second sheet 1330', and open regions 1334 in the first sheet 1330 overlap solid regions 1332' in the second sheet 1330'. In FIG. 14, the top, first sheet 1330 is shown in white, and the bottom, second sheet 1330' has solid regions 1332' shown in light gray and open regions 1334' shown in darker gray. More specifically, in some embodiments employing continuous solid regions 1332, as shown in FIG. 14, the solid regions 1332 can include islands and one or more connections, or bridges, positioned to connect each island to an adjacent island (as discussed subsequently).

As shown in FIG. 14, the first sheet 1330 includes islands 1350 having an octagonal shape, and each island 1350 is connected to one or more adjacent islands 1350 by one or more bridges 1352, respectively. The islands 1350 are arranged in a square-packed arrangement, such that the pattern of the sheet 1330 includes a repeat unit, or unit cell, comprising one central octagonal island 1350 that is connected to four adjacent islands 1350 by four bridges 1352, respectively, that are equally-spaced about the island 1350, such that every other octagonal edge of each island 1350 is connected to a bridge 1352. By way of example, each bridge 1352 includes a 90-degree bend, and each bridge 1352 coming from the same island 1350 bends in the same direction (i.e., clockwise or counter-clockwise), such that the open regions 1334 include a substantially square space between four adjacent islands 1350 that includes two bridges 1352, and such that the pattern of the first sheet 1330 includes 4-fold rotational symmetry about the center of each island 1350.

Furthermore, due to the dense packing of the islands 1350, the pattern includes staggered horizontal rows of islands 1350, staggered vertical rows of islands 1350, and diagonal rows of islands 1350. Each island 1350 has bridges 1352 bending in the same direction (i.e., clockwise or counter-clockwise) as that of any island 1350 in the same horizontal row, but in the opposite direction as that of any island 1350 in an adjacent horizontal row. Similarly, each island 1350 has bridges 1352 bending in the same direction (i.e., clockwise or counter-clockwise) as that of any island 1350 in the same vertical row, but in the opposite direction as that of any island 1036 in an adjacent vertical row. However, each island 1350 has bridges 1352 bending in the opposite direction as that of an adjacent island 1350 in the same diagonal row (in any direction).

The second sheet 1330' the same pattern as the first sheet 1330, i.e., also includes islands 1350' and bridges, but the bridges in the second sheet 1330' are not visible in FIG. 14, because the islands 1350 in the first sheet 1330 are positioned to overlap the bridges of the second sheet 1330'. In addition, each island 1350 in the first sheet 1330 also partially overlaps four islands 1350' in the second sheet 1330'.

The specific pattern of the sheets 1330, 1330' of FIG. 14 is shown by way of example only, and particularly, to illustrate how adjacent sheets 1330 (e.g., employing the same pattern) in the first portion 1301 can be staggered so that solid regions 1332 in one sheet 1330 can overlap open regions 1334' in an adjacent sheet 1330.

In addition, or alternatively, in some embodiments, adjacent sheets 1330 in the first portion 1301 (e.g., whether having the same or different patterns) can be rotated with respect to one another about a z-axis that is substantially orthogonal with respect to, or normal to, each sheet 1330. That is, in some embodiments, even if the sheets 1330 include the same pattern, one or more sheets 1330 can be rotated with respect to one another, such that the patterns do not directly and identically overlap one another. For example, in some embodiments, a first sheet 1330 can be rotated about the z-axis at an angle of 90 degrees with respect to a second sheet 1330. In some embodiments, e.g., if more than two sheets 1330 are employed, the sheets 1330 can be arranged such that the pattern rotation alternates with each sheet, such that a first and a third sheet may exactly overlap (i.e., are not rotated with respect to one another), while a second and a fourth sheet exactly overlap one another, but are rotated at an angle with respect to the first and the third sheets. In other embodiments, each sheet 1330 can be rotated at an angle with respect to each adjacent sheet 1330. For example, a second sheet 1330 can be rotated at an angle of 90 degrees with respect to a first sheet 1330, a third sheet 1330 can be rotated an angle of 90 degrees with respect to the second sheet 1330, and so on.

Figure 15:
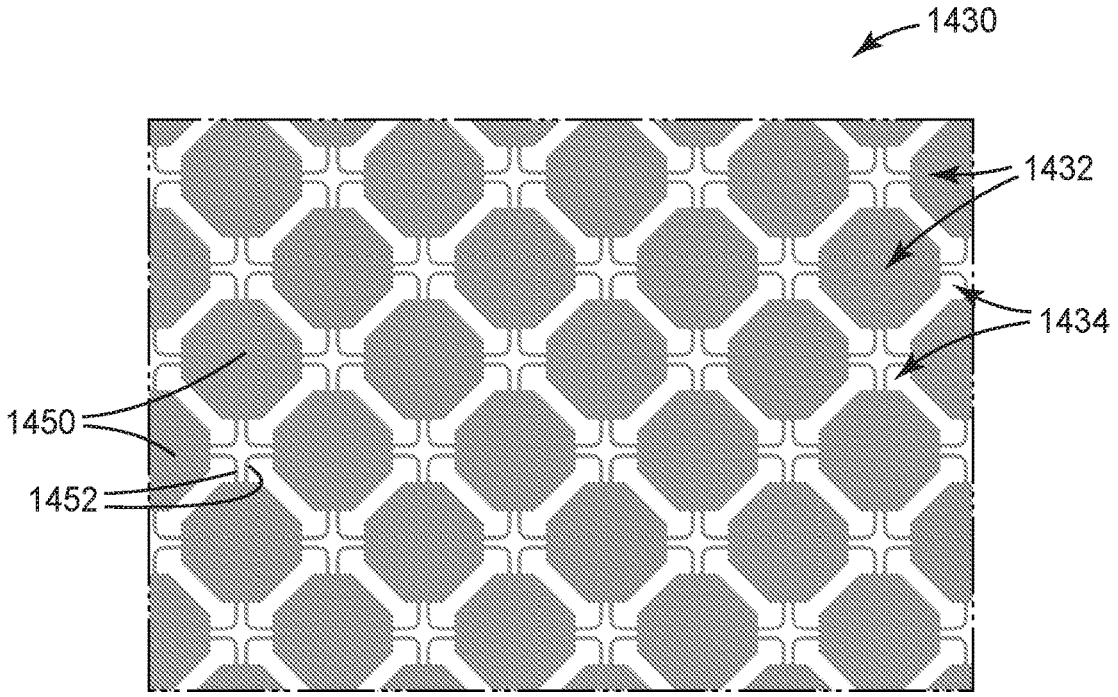
FIGS. 15-19 are each a top plan view of a sheet comprising solid regions and open regions according to another embodiment of the present disclosure.

FIG. 15 shows another sheet pattern according to another embodiment of the present application. In FIG. 15, the sheet has a pattern with two symmetric axes. Each sheet has large islands with small flexures that join them allowing movement between the islands In particular, FIG. 15 illustrates a sheet 1430 that includes solid regions 1432 and open regions 1434. The solid regions 1432 include islands 1450 having an octagonal shape, and each island 1450 is connected to each adjacent island 1450 by two bridges 1452, as described in greater detail below. The pattern of the sheet 1430 is similar to the sheets 1330 of FIG. 14, except that in the sheet 1430, each island includes four sides or edges that are each connected to two bridges 1452 instead of only one.

As shown in FIG. 15, the islands 1450 can be arranged in a square-packed arrangement, such that the pattern of the sheet 1430 includes a repeat unit, or unit cell, that can be propagated in any direction (i.e., left, right, up, down), comprising one central octagonal island 1450 that is connected to four adjacent islands 1450 by eight bridges 1452, i.e., two bridges 1452 per adjacent island 1450. The bridges 1452 can be equally-spaced about the central island 1450, such that every other octagonal edge of the central island 1450 is connected to two bridges 1452. By way of example, each bridge 1452 can include a 90-degree bend, and each pair of bridges 1452 coming from the same edge of an island 1450 bend in opposite directions from one another, i.e., clockwise and counter-clockwise, such that the open regions 1434 include a repeat unit comprising a substantially square space between four adjacent islands 1450 that includes four bridges 1452 bending toward a center of the square space, and such that the pattern of the first sheet 1430 includes 4-fold rotational symmetry about the center of each island 1450 in addition to 4 axes of symmetry.

Figure 16:
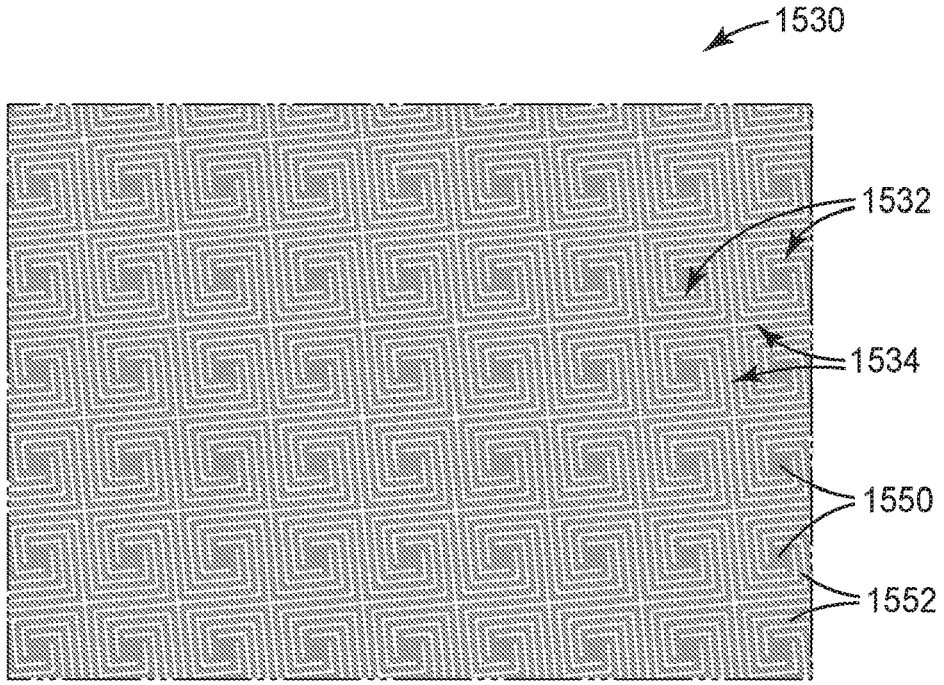

FIG. 16 shows another sheet pattern according to another embodiment of the present application. In FIG. 16, the sheet has two symmetric axes. The embodiment of FIG. 16 has small, square shaped islands connected with longer spiraling flexures. The spirals can have more or fewer bends in them. The islands can be rectangular and any size, for example.

FIG. 16 illustrates a sheet 1530 according to another embodiment of the present disclosure. The sheet 1530 includes solid regions 1532 and open regions 1534. The solid regions 1532 include islands 1550 having a substantially square shape, and each island 1550 is connected to each adjacent island 1550 by one bridge 1552, respectively. As shown in FIG. 16, the islands 1550 are arranged in a square-packed arrangement, such that the pattern of the sheet 1530 includes a repeat unit, or unit cell, comprising one island 1550 and a portion of its four bridges 1552 extending therefrom to adjacent islands 1550. Each island 1550 in FIG. 16 can be connected to four adjacent islands 1550 by four bridges 1552, respectively. For example, a first island 1550 is connected to one island 1550 above and one island 1550 below; and the first island 1550 can be further connected to one island 1550 on its left and one island 1550 on its right. Each bridge 1552 can have a width that is substantially less than the width of one side or edge of the island 1550 and extends from a side of the island 1550 directly adjacent a corner of the square island 1550.

By way of example, each bridge 1552 can include eight 90-degree bends, the first four bends all going in the same direction (i.e., clockwise) to spiral outwardly around the island 1550 from which it extends, the second four bends all going in the opposite direction (i.e., counter-clockwise) to spiral inwardly around and to an adjacent island 1550. As a result, the lengths of the bridge 1552 between its adjacent bends progressively increase around the island 1550 from which it extends, while the lengths of the bridge 1552 between its adjacent bends progressively decrease around the adjacent islands 1550 to which it extends and connects.

Figure 17:
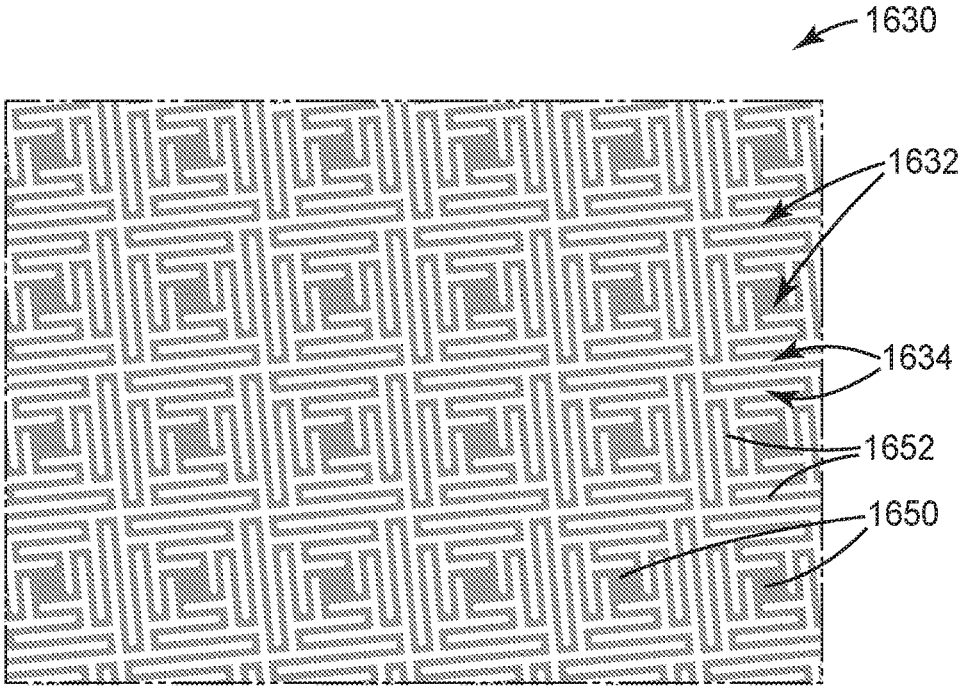

FIG. 17 shows another sheet pattern according to another embodiment of the present application. In FIG. 17, the sheet has a pattern with two symmetric axes. Each sheet has islands that are connected by flexures that wind back and forth. They could wind more or fewer times than shown. The islands can be rectangular and any size.

FIG. 17 illustrates a sheet 1630 that can include solid regions 1632 and open regions 1634. The solid regions 1632 include islands 1650 having a substantially square shape, and each island 1650 is connected to each adjacent island 1650 by one bridge 1652, respectively. Each bridge 1652 includes fourteen 90-degree bends; or a first 90-degree bend, followed by six 180-degree bends to essentially zig-zag outwardly from a side of one island 1650 toward a side of an adjacent island 1650, followed by a final 90-degree bend to connect to the adjacent island 1650; and (iii) the first 90-degree bend coming from each side of a given island 1650 turns counter-clockwise (or left), and the final 90-degree bend into an adjacent island 1650 turns in the opposite direction, i.e., clockwise, or right).

Figure 18:
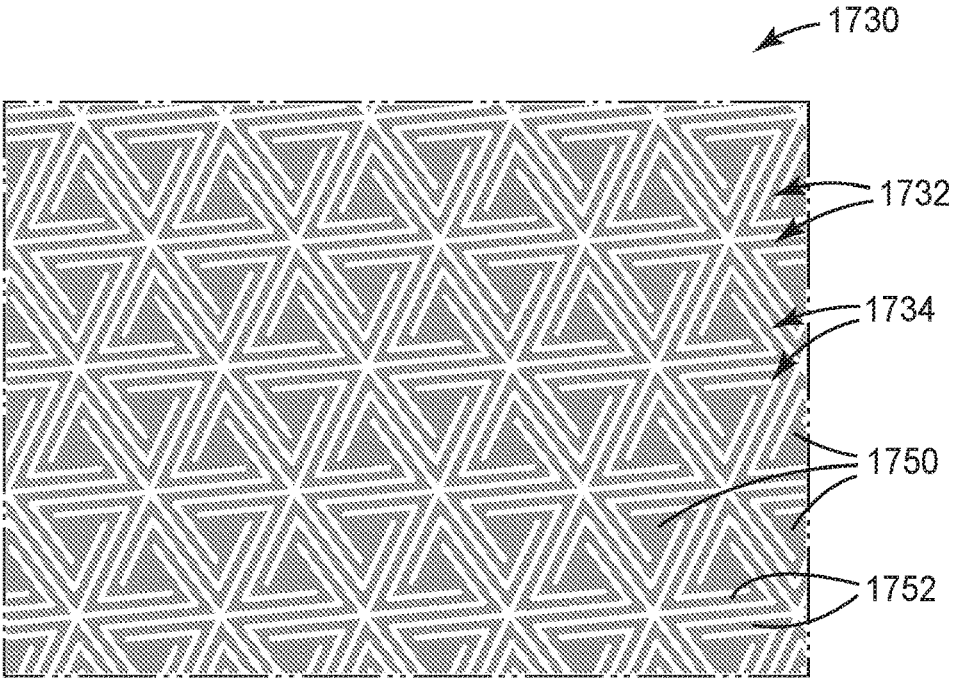

FIG. 18 illustrates an embodiment of a sheet 1730 having three symmetric axes. The islands are connected by spiraling flexures. The sheet 1730 includes solid regions 1732 and open regions 1734. The solid regions 1732 include islands 1750, and each island 1750 is connected to each adjacent island 1750 by one bridge 1752, respectively. The pattern shown in FIG. 18 has each bridge 1752 include four 60-degree bends, such that each side of an island 1750 is separated from a side of an adjacent island 1750 by three bridges 1752, and the lengths of a bridge 1752 between adjacent bends increase as the bridge 1752 extends around an island 1750 to a position where the bridge 1752 runs between the two adjacent islands 1750 it connects, and then decrease as the bridge 1752 extends around and connects to a side of the adjacent island 1750. In addition, each leg of the six-legged asterisk-shaped open regions 1734 includes a pronged end that is bent at 60 degrees with respect to the leg from which it extends. Although, FIG. 18 shows a specific embodiment having a particular number of bends, any number of bends could be used. Similarly, any size of islands (or varying size of islands) can be used.

Figure 19:
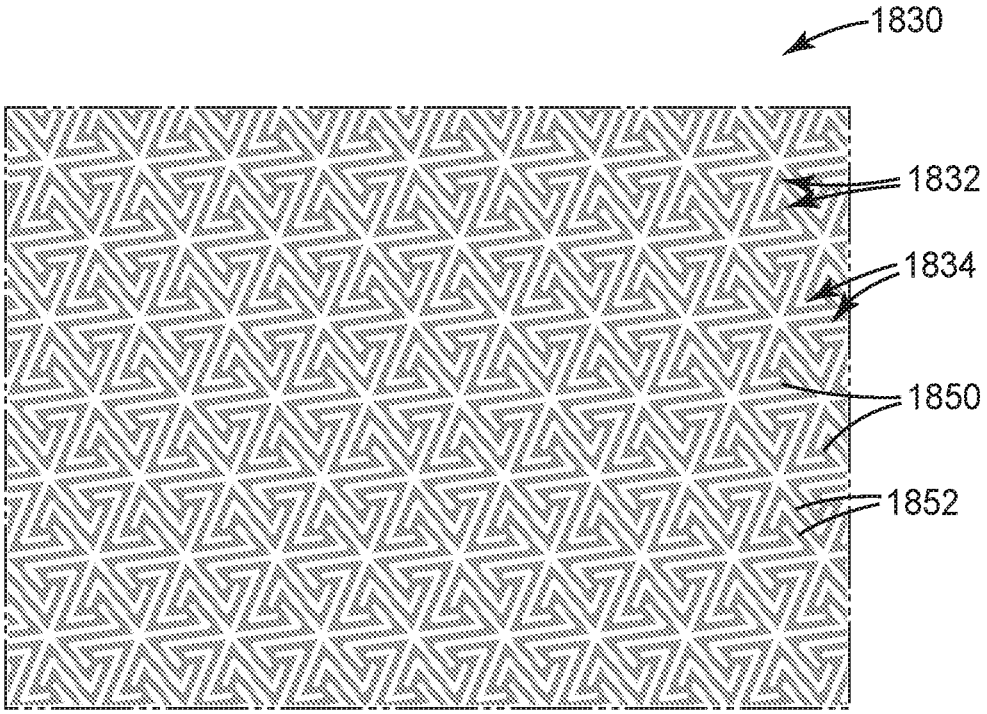

FIG. 19 illustrates a sheet 1830 according to another embodiment of the present disclosure. The sheet 1830 includes solid regions 1832 and open regions 1834. The solid regions 1832 include islands 1850, and each island 1850 is connected to each adjacent island 1850 by one bridge 1852, respectively. The pattern shown in FIG. 19 is substantially the same as that of FIG. 18, except that the asterisk-shaped open regions 1834 are more densely packed, such that each leg of one asterisk-shaped open region 1834 substantially overlaps a leg of an adjacent asterisk-shaped open region 1834. As a result, the islands 1834 of FIG. 19 are smaller than those of FIG. 18, and the bridges 1852 of FIG. 19 are narrower than those of FIG. 18.

The following embodiments are intended to be illustrative of the present disclosure and not limiting.

VARIOUS NOTES & EXAMPLES

Example 1 is an apparatus comprising: a body; and a first portion coupled to the body and movable therewith, the first portion comprising: a rigidifying material positioned in a chamber defined by an envelope formed of a gas-impermeable material, wherein a pressure within the chamber is variable between at least a lower pressure state and a higher pressure state, in the higher pressure state the material is relatively flexible, and in the lower pressure state the material is relatively less flexible than in the higher pressure state, and a layer manipulatable by the rigidifying material, the layer has a first state when the pressure within the chamber is in the higher pressure state, in the first state the layer is formable by a target surface to take on a desired shape that is substantially a match of the target surface, the layer has a second state when the pressure within the chamber is in the lower pressure state, in the second state the layer maintains the desired shape and is substantially less formable than in the first state.

In Example 2, the subject matter of Example 1 optionally includes, further comprising an abrasive layer disposed on and secured to the layer.

In Example 3, the subject matter of Example 2 optionally includes, wherein the body is configured as a handle for the apparatus and is graspable by a hand of a user to move the abrasive layer along a surface of an object with the layer in the second state.

In Example 4, the subject matter of any one or more of Examples 2-3 optionally include, further comprising a device that is operably configured to power a movement of the first portion, wherein the device is configured to vibrate at least the abrasive layer against the target surface.

In Example 5, the subject matter of any one or more of Examples 1-4 optionally include, further comprising a port positioned to fluidly couple the chamber with ambience, and wherein the lower pressure state comprises substantially a vacuum state where air has been evacuated from the chamber via the port.

In Example 6, the subject matter of any one or more of Examples 1-5 optionally include, wherein the rigidifying material comprises at least one of relatively thin sheets, fibers, strips of thin sheets, and discrete particles of a bulk media.

In Example 7, the subject matter of any one or more of Examples 1-6 optionally include, wherein the rigidifying material comprises at least two sheets positioned in the chamber in an at least partially overlapping configuration, and wherein in the higher pressure state the at least two sheets are relatively moveable with respect to one another, and in the lower pressure state the at least two sheets are relatively less moveable with respect to one another than in the higher pressure state.

In Example 8, the subject matter of Example 7 optionally includes, wherein each sheet comprises a major surface, and wherein at least a portion of each sheet is patterned to include solid regions and void regions, the solid regions being movable with respect to one another within the major surface.

In Example 9, the subject matter of Example 8 optionally includes, wherein the solid regions extend uninterrupted along axes that are generally parallel with one another and the void regions extend along axes that generally parallel with one another and are generally oriented to extend parallel with the axes of the solid regions.

In Example 10, the subject matter of any one or more of Examples 1-9 optionally include, wherein the first portion is configured to be formable against the target surface along at least one of: only a single axis of the first portion or a plurality of axes of the first portion.

In Example 11, the subject matter of any one or more of Examples 1-10 optionally include, further comprising a stiffening configuration that stiffens the layer relative to the body with respect to at least one axis of the layer.

In Example 12, the subject matter of Example 11 optionally includes, wherein the stiffening configuration comprises at least one of: a plurality of stiffening elements extending between the body and the first portion, one or more edges of the body are coupled to one or more edges of the layer, and a support for retaining one or more edges of the layer to the body.

In Example 13, the subject matter of any one or more of Examples 1-12 optionally include, further comprising a second portion disposed between the body and the first portion, the second portion configured to urge the layer to conform to the desired shape of the target surface.

In Example 14, the subject matter of Example 13 optionally includes, wherein the second portion comprises one or more of: a foam, a layered foam, a bladder filled with a fluid, a volume configured to be accessible to an implement, a volume configured to be accessible to a human hand, and a plurality of urging elements.

In Example 15, the subject matter of any one or more of Examples 1-14 optionally include, wherein the chamber is coupled to a vacuum device.

Example 16 is a method of using an apparatus as a copy block, the method comprising: providing the apparatus including a body and a first portion coupled to the body; passing a gas to and from a chamber within the first portion such that the chamber has at least a lower pressure state and a higher pressure state, in the higher pressure state a rigidifying material disposed within the chamber is relatively flexible, and in the lower pressure state the material is relatively less flexible than in the higher pressure state; forming a layer into a desired shape by forcing the layer against a target surface to take on the desired shape that is substantially a match of the target surface with the chamber in the higher pressure state; and modifying a flexibility of the layer of the first portion to maintain the desired shape of the layer by changing a flexibility of the rigidifying material.

In Example 17, the subject matter of Example 16 optionally includes, further comprising: maintaining the desired shape of the layer by keeping the chamber in the lower pressure state; and moving the apparatus to contact the first portion with a surface of an object with the layer maintained in the desired shape.

In Example 18, the subject matter of any one or more of Examples 16-17 optionally include, further comprising sanding a layer of an object with an abrasive layer disposed on and secured to the layer, the sanding occurring with the layer having the desired shape and the chamber in the lower pressure state.

In Example 19, the subject matter of Example 18 optionally includes, further comprising vibrating at least the abrasive layer against the target surface during the sanding.

In Example 20, the subject matter of any one or more of Examples 16-19 optionally include, further comprising performing at least one of filling, smoothing, and molding with the layer having the desired shape.

In Example 21, the subject matter of any one or more of Examples 16-20 optionally include, further comprising urging the layer to conform to the desired shape of the target surface.

In Example 22, the subject matter of any one or more of Examples 16-20 optionally include, further comprising stiffening the layer along at least one axis of the layer the stiffening occurring relative to the body.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention can be determined with reference to the appended claims, along with the full scope of equivalents to which such claims are entitled.

The claimed invention is:

1. An apparatus comprising:

a body;

a first portion coupled to the body and movable therewith, the first portion comprising:

a rigidifying material positioned in a chamber defined by an envelope formed of a gas-impermeable material, wherein a pressure within the chamber is variable between at least a lower pressure state and a higher pressure state, in the higher pressure state the material is relatively flexible, and in the lower pressure state the material is relatively less flexible than in the higher pressure state, and a layer manipulateable by the rigidifying material, the layer has a first state when the pressure within the chamber is in the higher pressure state, in the first state the layer is formable by a target surface to take on a desired shape that is substantially a match of the target surface, the layer has a second state when the pressure within the chamber is in the lower pressure state, in the second state the layer maintains the desired shape and is substantially less formable than in the first state; and a second portion disposed between the body and the first portion, the second portion configured to urge the layer to conform to the desired shape of the target surface, wherein the rigidifying material comprises at least two sheets positioned in the chamber in an at least partially overlapping configuration, and wherein in the higher pressure state the at least two sheets are relatively moveable with respect to one another, and in the lower pressure state the at least two sheets are relatively less moveable with respect to one another than in the higher pressure state.

2. The apparatus of claim 1, further comprising an abrasive layer disposed on and secured to the layer.

3. The apparatus of claim 2, wherein the body is configured as a handle for the apparatus and is graspable by a hand of a user to move the abrasive layer along a surface of an object with the layer in the second state.

4. The apparatus of claim 1, further comprising a port positioned to fluidly couple the chamber with ambience, and wherein the lower pressure state comprises substantially a vacuum state where air has been evacuated from the chamber via the port.

5. The apparatus of claim 1, wherein each sheet comprises a major surface, and wherein at least a portion of each sheet is patterned to include solid regions and void regions, the solid regions being movable with respect to one another within the major surface.

6. The apparatus of claim 5, wherein the solid regions extend uninterrupted along axes that are generally parallel with one another and the void regions extend along axes that generally parallel with one another and are generally oriented to extend parallel with the axes of the solid regions.

7. The apparatus of claim 1, further comprising a stiffening configuration that stiffens the layer relative to the body with respect to at least one axis of the layer.

* * * * *